US011650023B2

(12) United States Patent
Sullivan et al.

(10) Patent No.: US 11,650,023 B2
(45) Date of Patent: May 16, 2023

(54) SELECTIVE FIRE FIREARM SYSTEMS AND METHODS

(71) Applicant: ArmWest, LLC, Prescott, AZ (US)

(72) Inventors: Leroy James Sullivan, Prescott, AZ (US); Cody Lee Rients, Mesa, AZ (US)

(73) Assignee: Arm West, LLC, Prescott, AZ (US)

( * ) Notice: Subject to any disclaimer, the term of this patent is extended or adjusted under 35 U.S.C. 154(b) by 525 days.

(21) Appl. No.: 16/695,018

(22) Filed: Nov. 25, 2019

(65) Prior Publication Data

US 2020/0103192 A1 Apr. 2, 2020

Related U.S. Application Data

(62) Division of application No. 15/275,253, filed on Sep. 23, 2016, now Pat. No. 10,488,136.

(51) Int. Cl.

| | |
|---|---|
| ***F41A 19/46*** | (2006.01) |
| ***F41A 19/17*** | (2006.01) |
| ***F41A 17/42*** | (2006.01) |
| ***F41A 17/16*** | (2006.01) |
| ***F41A 17/56*** | (2006.01) |

(Continued)

(52) U.S. Cl.

CPC ..... *F41A 19/46* (2013.01); *F41A 3/72* (2013.01); *F41A 17/02* (2013.01); *F41A 17/16* (2013.01); *F41A 17/42* (2013.01); *F41A 17/46* (2013.01); *F41A 17/56* (2013.01); *F41A 19/10* (2013.01);

(Continued)

(58) Field of Classification Search

CPC ..... F41A 17/42; F41A 17/00; F41A 17/56; F41A 19/46; F41A 19/10; F41A 19/12; F41A 19/14

See application file for complete search history.

(56) References Cited

U.S. PATENT DOCUMENTS

| | | | |
|---|---|---|---|
| 804,986 | A | 11/1905 | Stamm |
| 980,980 | A | 1/1911 | Maggio |

(Continued)

FOREIGN PATENT DOCUMENTS

| | | |
|---|---|---|
| CH | 37247 | 5/1907 |
| CH | 199224 | 8/1938 |

(Continued)

OTHER PUBLICATIONS

"HS-Precision—Magazine Feed Liptool", Brownells, 1 page, [online], [retrieved on May 21, 2015], Retrieved from the internet: <URL: http://www.brownells.com/.aspx/pid=25049/Product/Magazine-Feed-Liptool>.

*Primary Examiner* — Benjamin P Lee

(74) *Attorney, Agent, or Firm* — Haynes and Boone, LLP

(57) ABSTRACT

A selective fire firearm may be provided having a fully automatic open bolt and a semi-automatic closed bolt mode of operation. The firearm may include a trigger group having a trigger prop that ensures that, when the trigger is released in the fully automatic open bolt mode, the bolt carrier stops in an open bolt position held by an open bolt sear. The trigger prop may include a foot that, following a first trigger pull in the fully automatic open bolt mode, slides under and props a rear end of the trigger in a position that allows the open bolt sear to catch the bolt carrier when the trigger is released and propped but prevents the trigger sear from engaging the hammer.

22 Claims, 23 Drawing Sheets

(51) Int. Cl.

| | |
|---|---|
| ***F41A 3/72*** | (2006.01) |
| ***F41A 17/02*** | (2006.01) |
| ***F41A 17/46*** | (2006.01) |
| ***F41A 19/10*** | (2006.01) |
| ***F41A 19/12*** | (2006.01) |
| ***F41A 19/14*** | (2006.01) |
| ***F41A 19/15*** | (2006.01) |

(52) U.S. Cl.

CPC ..... *F41A 19/12* (2013.01); *F41A 19/14* (2013.01); *F41A 19/15* (2013.01); *F41A 19/17* (2013.01)

(56) References Cited

U.S. PATENT DOCUMENTS

| | | | | |
|---|---|---|---|---|
| 1,202,707 | A | 10/1916 | Greico | |
| 1,227,439 | A | 5/1917 | Hilgendorf | |
| 1,357,949 | A | 11/1920 | Brooks | |
| 1,363,262 | A | 12/1920 | North | |
| 1,402,459 | A | 1/1922 | Swebilius | |
| 1,413,409 | A | 4/1922 | Lackman | |
| 1,431,059 | A | 10/1922 | Sutter | |
| 1,439,903 | A | 12/1922 | Lewis | |
| 1,476,657 | A | 12/1923 | Tawney | |
| 1,500,580 | A | 7/1924 | Matteo | |
| 1,588,887 | A | 6/1926 | Haubroe | |
| 1,771,311 | A | 7/1930 | Phliponeau | |
| 1,907,164 | A | 5/1933 | White | |
| 1,946,388 | A | 2/1934 | Chevallier | |
| 2,068,289 | A | 1/1937 | Thomas | |
| 2,088,268 | A | 7/1937 | Lauf | |
| 2,096,028 | A | 10/1937 | Burton et al. | |
| 2,147,208 | A | 2/1939 | Nolan | |
| 2,217,848 | A | 10/1940 | Victor | |
| 2,287,066 | A | 6/1942 | Rogers | |
| 2,345,031 | A | 3/1944 | Carithers | |
| 2,361,985 | A | 11/1944 | Birkigt | |
| 2,365,306 | A | 12/1944 | Swebilius | |
| 2,365,392 | A | 12/1944 | Cooley | |
| 2,376,466 | A | 5/1945 | Williams | |
| 2,391,756 | A | 12/1945 | Vesely | |
| 2,429,204 | A | 10/1947 | Gunner et al. | |
| 2,462,119 | A | 2/1949 | Moore | |
| 2,466,196 | A | 4/1949 | Baker | |
| 2,482,880 | A | 9/1949 | Sefried, II | |
| 2,488,233 | A | 11/1949 | Pelo | |
| 2,495,460 | A | 1/1950 | Koucky | |
| 2,503,116 | A | 4/1950 | Maillard | |
| 2,510,685 | A | 6/1950 | Chevallier et al. | |
| 2,589,274 | A | 3/1952 | Moratta | |
| 2,712,192 | A | 7/1955 | Dixon | |
| 2,756,640 | A | 7/1956 | Maillard | |
| 2,910,332 | A | 10/1959 | Madsen | |
| 2,918,848 | A | 12/1959 | Maillard | |
| 2,981,154 | A | 4/1961 | Sweeney | |
| 3,043,198 | A | 7/1962 | Burns et al. | |
| 3,090,148 | A | 5/1963 | Smith | |
| 3,090,149 | A | 5/1963 | Marlas | |
| 3,198,076 | A | 8/1965 | Stoner | |
| 3,226,869 | A | 1/1966 | Musgrave | |
| 3,236,155 | A | 2/1966 | Sturtevant | |
| 3,283,435 | A | 11/1966 | Oberndorf | |
| 3,290,815 | A | 12/1966 | Edwards | |
| 3,300,889 | A | 1/1967 | Baker | |
| 3,318,192 | A | 5/1967 | Sullivan et al. | |
| 3,330,183 | A | 7/1967 | Löffler | |
| 3,333,510 | A | 8/1967 | Muhlemann | |
| 3,345,771 | A | 10/1967 | Silsby | |
| 3,346,982 | A | 10/1967 | Loffler et al. | |
| 3,366,011 | A | 1/1968 | Stutervant | |
| 3,381,405 | A | 5/1968 | Edwards | |
| 3,429,223 | A | 2/1969 | Seccombe | |
| 3,440,751 | A | 4/1969 | Fremont | |
| 3,604,142 | A | 9/1971 | Silsby | |
| 3,641,691 | A | 2/1972 | Ellis et al. | |
| 3,672,089 | A | 6/1972 | Silsby | |
| 3,688,641 | A | 9/1972 | Curtis et al. | |
| 3,795,173 | A | 3/1974 | Freymond | |
| 3,969,983 | A | 7/1976 | Zellweger et al. | |
| 3,977,114 | A | 8/1976 | Poor | |
| 3,990,348 | A | 11/1976 | Vesamaa | |
| 4,020,740 | A | 5/1977 | Schirneker | |
| 4,057,003 | A | 11/1977 | Atchisson | |
| 4,127,954 | A | 12/1978 | Hausmann | |
| 4,142,314 | A | 3/1979 | Foote | |
| 4,150,819 | A | 4/1979 | Taylor | |
| 4,279,091 | A | 7/1981 | Edwards | |
| 4,388,773 | A | 6/1983 | Beretta | |
| 4,416,186 | A | 11/1983 | Sullivan | |
| 4,428,137 | A | 1/1984 | Johnson | |
| 4,440,062 | A | 4/1984 | McQueen | |
| 4,446,645 | A | 5/1984 | Kelsey, Jr. | |
| 4,448,109 | A | 5/1984 | Johnson | |
| 4,505,182 | A | 3/1985 | Sullivan | |
| 4,524,672 | A | 6/1985 | Balsavage | |
| 4,589,218 | A | 5/1986 | Teppa | |
| 4,754,567 | A * | 7/1988 | Lehfeldt ..... | F41A 19/17 42/69.01 |
| 4,765,224 | A | 8/1988 | Morris | |
| 4,769,938 | A | 9/1988 | Chesnut et al. | |
| 4,833,970 | A | 5/1989 | Wilhelm | |
| 4,910,904 | A | 3/1990 | Rose | |
| 4,986,018 | A | 1/1991 | Mcdonald, Jr. | |
| 5,155,284 | A | 10/1992 | Flashkes | |
| 5,168,648 | A | 12/1992 | Brandl | |
| 5,267,406 | A | 12/1993 | Ruger | |
| 5,343,649 | A | 9/1994 | Petrovich | |
| 5,448,940 | A | 9/1995 | Schuetz et al. | |
| 5,495,687 | A | 3/1996 | Waiser | |
| 5,561,933 | A | 10/1996 | Czekalski | |
| 5,617,664 | A | 4/1997 | Troncoso | |
| 5,634,288 | A | 6/1997 | Martel | |
| 5,713,150 | A | 2/1998 | Ealovega | |
| 5,726,377 | A | 3/1998 | Harris et al. | |
| 5,827,992 | A | 10/1998 | Harris et al. | |
| 5,857,280 | A * | 1/1999 | Jewell ..... | F41A 19/45 42/70.05 |
| 5,900,577 | A | 5/1999 | Robinson et al. | |
| 5,909,002 | A | 6/1999 | Atchisson | |
| 5,920,028 | A | 7/1999 | Guhring et al. | |
| 6,340,161 | B1 | 1/2002 | Zitting | |
| 6,484,430 | B1 | 11/2002 | Robinson et al. | |
| 6,606,812 | B1 | 8/2003 | Gwinn, Jr. | |
| 6,609,319 | B1 | 8/2003 | Olson | |
| 6,722,255 | B2 | 4/2004 | Herring | |
| 6,829,974 | B1 | 12/2004 | Gwinn, Jr. | |
| 6,848,351 | B1 | 2/2005 | Davies | |
| 6,898,888 | B2 | 5/2005 | Greenhut | |
| 6,931,978 | B1 | 8/2005 | Dionne | |
| 7,117,626 | B1 | 10/2006 | Alzamora | |
| 7,275,472 | B1 | 10/2007 | Finn | |
| 7,293,385 | B2 | 11/2007 | McCormick | |
| 7,464,496 | B1 | 12/2008 | Davies et al. | |
| 7,627,974 | B2 | 12/2009 | Olson | |
| 7,793,453 | B1 | 9/2010 | Sewell, Jr. et al. | |
| 7,823,314 | B1 | 11/2010 | Wheatley | |
| 7,827,722 | B1 | 11/2010 | Davies | |
| 7,832,326 | B1 | 11/2010 | Barrett | |
| 7,886,470 | B1 | 2/2011 | Doiron | |
| 7,938,055 | B2 | 5/2011 | Hochstrate et al. | |
| 8,028,611 | B2 | 10/2011 | Loundsbury | |
| 8,061,071 | B2 | 11/2011 | Fitzpatrick et al. | |
| 8,087,194 | B1 | 1/2012 | Vuksanovich | |
| 8,141,285 | B2 | 3/2012 | Brown | |
| 8,205,373 | B1 | 6/2012 | Ubi et al. | |
| 8,210,089 | B2 | 7/2012 | Brown | |
| 8,261,653 | B2 | 9/2012 | Crommett | |
| 8,297,175 | B1 | 10/2012 | Davies | |
| 8,316,756 | B1 | 11/2012 | Woodell et al. | |
| 8,365,454 | B2 | 2/2013 | Hogan, Jr. | |
| 8,561,337 | B2 | 10/2013 | Lewis | |
| 8,887,426 | B2 | 11/2014 | Feese | |
| 9,046,313 | B1 * | 6/2015 | Lutton ..... | F41A 19/15 |

(56) References Cited

U.S. PATENT DOCUMENTS

| | | | | |
|---|---|---|---|---|
| 9,097,478 | B1 | 8/2015 | Karagias | |
| 9,217,615 | B2 | 12/2015 | Lewis | |
| 9,383,153 | B2 | 7/2016 | Nebeker et al. | |
| 9,719,744 | B2 * | 8/2017 | Horch | F41A 19/10 |
| 9,829,262 | B1 | 11/2017 | Suttle et al. | |
| 9,927,197 | B1 * | 3/2018 | Geissele | F41A 19/45 |
| 9,989,327 | B2 * | 6/2018 | Horch | F41A 19/10 |
| 10,156,410 | B1 * | 12/2018 | McKillips | F41A 19/45 |
| 10,488,134 | B2 * | 11/2019 | Olson | F41A 19/10 |
| 2003/0154640 | A1 | 8/2003 | Bragg | |
| 2003/0188567 | A1 | 10/2003 | Garrett | |
| 2004/0128898 | A1 | 7/2004 | Popikow | |
| 2005/0260545 | A1 | 11/2005 | Schavone | |
| 2005/0262752 | A1 | 12/2005 | Robinson et al. | |
| 2007/0051236 | A1 * | 3/2007 | Groves | F41A 19/46 89/142 |
| 2007/0199435 | A1 | 8/2007 | Hochstrate et al. | |
| 2008/0092733 | A1 | 4/2008 | Leitner-Wise et al. | |
| 2008/0134557 | A1 | 6/2008 | Wossner et al. | |
| 2008/0168695 | A1 | 7/2008 | Nakayama | |
| 2009/0031607 | A1 | 2/2009 | Robinson | |
| 2009/0071053 | A1 | 3/2009 | Thomele et al. | |
| 2009/0151213 | A1 | 6/2009 | Bell | |
| 2009/0183414 | A1 * | 7/2009 | Geissele | F41A 19/10 42/69.03 |
| 2010/0095833 | A1 | 4/2010 | Gavage et al. | |
| 2010/0126053 | A1 | 5/2010 | Fitzpatrick et al. | |
| 2010/0163250 | A1 | 7/2010 | Schultz | |
| 2010/0269389 | A1 | 10/2010 | Lopez | |
| 2010/0300278 | A1 | 12/2010 | Zedrosser | |
| 2011/0005384 | A1 | 1/2011 | Lewis et al. | |
| 2011/0173857 | A1 | 7/2011 | Hogan, Jr. | |
| 2011/0315002 | A1 * | 12/2011 | Keough | F41A 19/46 89/128 |
| 2012/0131831 | A1 | 5/2012 | Sullivan et al. | |
| 2012/0137869 | A1 | 6/2012 | Gomez et al. | |
| 2012/0152105 | A1 | 6/2012 | Gomez et al. | |
| 2013/0111794 | A1 | 5/2013 | Dionne et al. | |
| 2013/0111796 | A1 * | 5/2013 | Dionne | F41A 17/00 42/70.11 |
| 2013/0139424 | A1 | 6/2013 | Devine | |
| 2014/0075798 | A1 | 3/2014 | Kincel | |
| 2015/0059221 | A1 | 3/2015 | Bero | |
| 2015/0253094 | A1 * | 9/2015 | Reynolds | F41A 19/10 42/69.01 |
| 2016/0131449 | A1 * | 5/2016 | Horch | F41A 19/12 42/69.01 |
| 2016/0363401 | A1 * | 12/2016 | Elftmann | F41A 19/14 |
| 2017/0115089 | A1 * | 4/2017 | Middleton | F41B 5/1469 |
| 2017/0138689 | A1 * | 5/2017 | Biegel | F41A 19/14 |

FOREIGN PATENT DOCUMENTS

| | | |
|---|---|---|
| CH | 631542 | 8/1982 |
| CN | 1219231 | 6/1999 |
| CN | 101403587 | 4/2009 |
| CN | 202470894 | 10/2012 |
| CN | 102865772 | 1/2013 |
| CN | 103443575 | 12/2013 |
| CN | 103518118 | 1/2014 |
| CN | 104335003 | 2/2015 |
| DE | 242206 | 12/1911 |
| DE | 329336 | 11/1920 |
| DE | 419803 | 10/1925 |
| DE | 478630 | 6/1929 |
| DE | 569280 | 2/1933 |
| DE | 203574 | 8/1938 |
| DE | 664926 | 9/1938 |
| DE | 712084 | 10/1941 |
| DE | 858944 | 12/1952 |
| DE | 3707925 | 9/1988 |
| DE | 102006011278 | 9/2007 |
| DE | 102007011502 | 9/2008 |
| DE | 102007034670 | 1/2009 |
| EP | 0055690 | 7/1982 |
| EP | 1479997 | 11/2004 |
| EP | 1596151 | 11/2005 |
| EP | 2045561 | 4/2009 |
| EP | 2141437 | 1/2010 |
| FR | 1362361 | 5/1964 |
| GB | 166579 | 7/1921 |
| GB | 441687 | 1/1936 |
| GB | 525429 | 8/1940 |
| GB | 536728 | 12/1944 |
| GB | 604348 | 7/1948 |
| GB | 1140405 | 1/1969 |
| GB | 1227706 | 4/1971 |
| GB | 1338189 | 11/1973 |
| GB | 2231943 | 11/1990 |
| JP | 2003/287127 | 10/2003 |
| RU | 2232368 | 7/2004 |
| RU | 2392562 | 6/2010 |
| RU | 2507467 | 2/2014 |
| RU | 2525339 | 8/2014 |
| TW | 200916717 | 4/2009 |
| TW | M371871 | 1/2010 |
| TW | 201024655 | 7/2010 |
| TW | I422794 | 1/2014 |
| WO | WO97/25581 | 7/1997 |
| WO | WO2009/137132 | 11/2009 |
| WO | WO2010/132543 | 11/2010 |
| WO | WO 2013/138918 | 9/2013 |

* cited by examiner

SELECTIVE FIRE FIREARM SYSTEMS AND METHODS

CROSS-REFERENCE TO RELATED APPLICATIONS

This application is a divisional of U.S. patent application Ser. No. 15/275,253 filed Sep. 23, 2016 and entitled "SELECTIVE FIRE FIREARM SYSTEMS AND METHODS" which is hereby incorporated by reference in its entirety.

TECHNICAL FIELD

One or more of the embodiments relate generally to firearms, and more particularly, for example, to a firearm configured for fully automatic open bolt or semi-automatic closed bolt firing.

BACKGROUND

Semi-automatic and fully automatic firearms are well known. Semi-automatic firearms shoot one bullet each time that the trigger is pulled. Fully automatic firearms continue shooting as long as the trigger is pulled and they have not exhausted their ammunition and are typically capable of relatively high rates of fire, e.g., cyclic rates. For example, the M16 and the M4 have a nominal cyclic rate of 700 to 950 rounds per minute.

Because fully automatic firearms are capable of such high cyclic rates, they are prone to a variety of problems. For example, sustained fully automatic fire may result in barrel overheating. Barrel overheating is particularly problematic when high capacity magazines, such as SureFire's 60 round and 100 round magazines, are being used. High capacity magazines allow longer periods of sustained fire since fewer magazine changes are required to fire a given number of rounds. Fewer magazine changes provide less time for the barrel to cool. Thus, the barrel, as well as other parts of the firearm, may be subjected to increased heat.

Often, the ability to keep firing is limited by barrel overheating, which may result in malfunction of the firearm. For example, cartridges chambered into an overheated barrel may detonate prematurely, e.g., cook off, particularly in closed bolt firearms.

If care is not taken, a fully automatic firearm, particularly a fully automatic mode of a selective fire firearm with a closed bolt semi-automatic mode, can cease fire in a closed bolt position with a cartridge chambered in the hot barrel. A fully automatic firearm resting in closed bolt position may be hazardous as cook off may occur.

The possibility of a cartridge firing due to cook off may have disastrous consequences in battlefield and police situations. The involuntary detonation of ammunition has resulted in injury or loss of life in such instances. Therefore, it would be desirable to provide systems and methods for facilitating improved firearm function.

BRIEF SUMMARY

In accordance with embodiments further described herein, features are provided that may be advantageously used in one or more firearm designs. More specifically, in accordance with an embodiment, a firearm is provided that fires fully automatic from the open bolt position to prevent cook off and have greater controllability, and fires semi-auto from a closed bolt position for accuracy. Furthermore, in accordance with an embodiment, a simple and reliable selector mechanism is provided for selection of mode of operation (e.g., semi-auto closed bolt or fully automatic open bolt) of the firearm. According to an embodiment, a selective fire firearm having a fully automatic mode and a semi-automatic mode may be provided with a trigger group having a trigger prop that, in the automatic mode, functions to ensure that, when the trigger is released following fully automatic fire, the firearm will cease fire in an open bolt position. In this way, the risk of cook off due to a cartridge chambered in a hot barrel after fully automatic fire may be reduced or eliminated.

For controllable full auto we use a variation of the Davis Recoilless Gun Principal that shot a bullet out the front and a sandbag out the rear so all the recoil was in the weight of the sandbag, none in the gun, no matter what the gun weighed. Instead of the sandbag we use the weight of the bolt carrier group and buffer and instead of throwing them out the back, we gave them enough room and spring force to gradually stop them before they hit a rear wall. Our gun is therefore not recoilless, but it delivers the lowest possible recoil force stretched out over the longest possible time (the time between one shot and the next) and it doesn't matter what the gun weighs. It does however require that each cycle be the same and should deliver half the recoil impulse while the cycling weight is decelerating rearward and half as the spring is accelerating the weight forward. If the second half of the first cycle is omitted from first shot of a full auto burst (as do most Assault Rifles), the first shot of the burst has up to twice the recoil impulse of subsequent shots which reduces full auto controllability of that burst.

Since changing the selector from closed bolt semi-auto to open bolt full auto will not cock the cycling weights rearward to open bolt position, the trigger mechanism provides two options. The user may use the cocking handle to cock the weights rearward or save time by immediately firing. It will then just fire the first shot of that burst from closed bolt, but cease fire in the open bolt and fire all subsequent bursts from open bolt.

According to an embodiment, a firearm is provided that includes a bolt carrier and a trigger group including a trigger having a trigger sear; a hammer having a notch configured to be engaged by the trigger sear to prevent firing when the trigger is released in a semi-automatic closed bolt mode of operation for the firearm; and a trigger prop configured to prevent engagement of the notch by the trigger sear in the fully automatic open bolt mode of operation. An open bolt sear may be provided and configured to block motion of the bolt carrier to prevent firing when the trigger is released in a fully automatic open bolt mode of operation.

According to another embodiment, a dual use trigger is provided that includes a trigger sear configured to engage a hammer notch of a standard hammer and a light pull sear configured to engage a hammer post of a light pull hammer.

According to another embodiment, a firearm is provided that includes a charging handle; a trigger; and a lever arm, in which, based on a position of the charging handle and a mode of operation of the firearm, the lever arm is configured to selectively block or allow a pull of the trigger.

According to another embodiment, an open bolt sear assembly for a firearm is provided that includes an open bolt sear, which includes a main body and at least two legs coupled to the main body, and a sear arm configured to interact with a trigger of the firearm. The main body may have a mating face that engages a bolt carrier. Furthermore, the two legs may each have engagement surfaces that engage the wall of the firearm. The open bolt sear assembly may also include a first and second pivot point that the sear arm and open bolt sear may rotate about, respectively. The open bolt sear assembly may be used in the firearm during, for example, AUTO OB mode of operation. For example, the open bolt sear is configured to block motion of a bolt carrier to prevent firing when the trigger of the firearm is released in a fully automatic open bolt mode of operation for the firearm; and the open bolt sear is configured to allow motion of the bolt carrier when the trigger is pulled in the fully automatic mode of operation.

These and other features and advantages of the present invention will be more readily apparent from the detailed description of the embodiments set forth below taken in conjunction with the accompanying drawings. The scope of the disclosure is defined by the claims, which are incorporated into this section by reference. A more complete understanding of embodiments, as well as a realization of additional advantages thereof, will be afforded to those skilled in the art by a consideration of the following detailed description of one or more embodiments.

BRIEF DESCRIPTION OF THE DRAWINGS

Embodiments of the present invention and their advantages are best understood by referring to the detailed description that follows. It should be appreciated that like reference numerals are used to identify like elements illustrated in one or more of the figures.

DETAILED DESCRIPTION

Figure 1A:
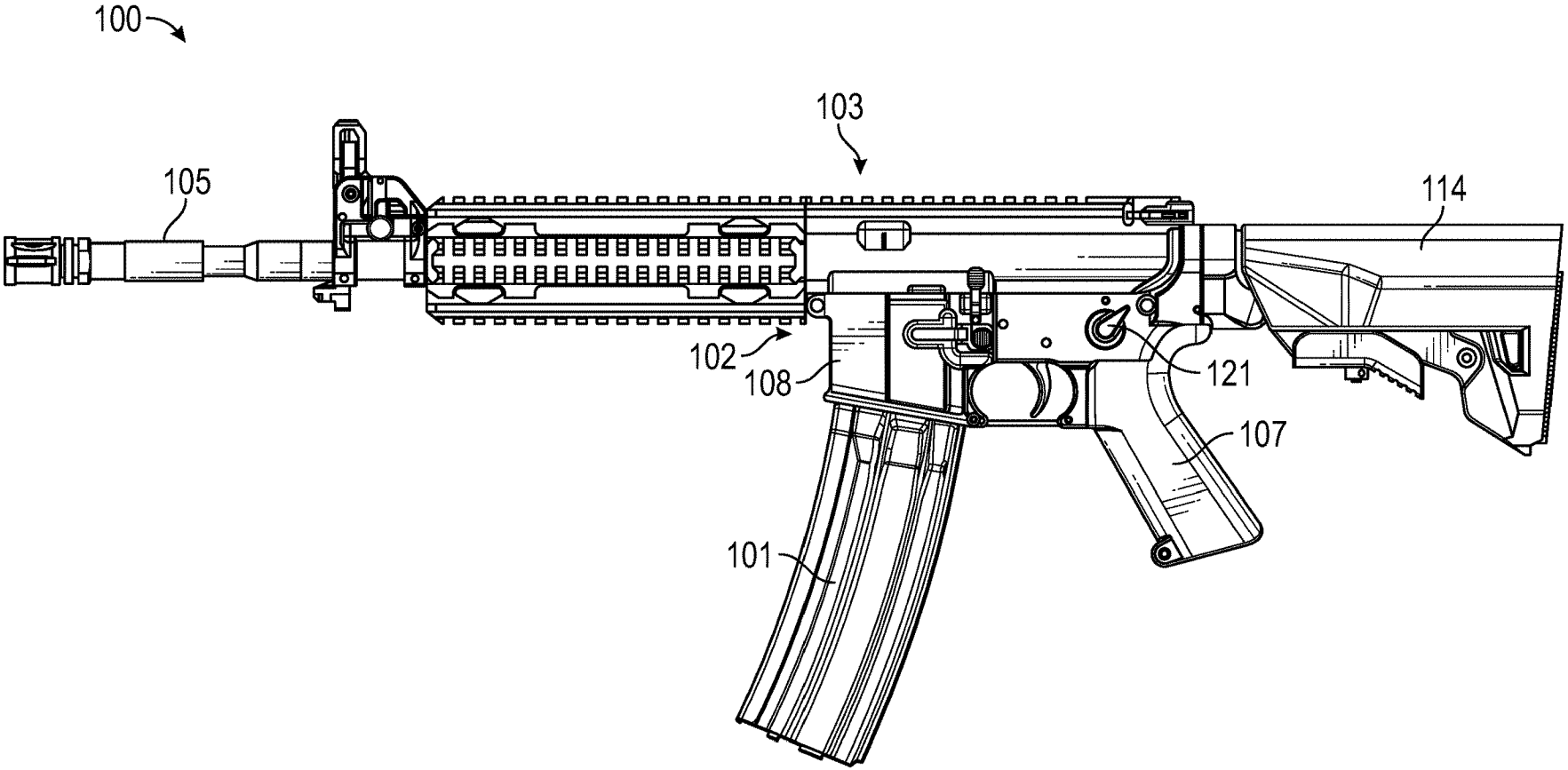
FIGS. 1A and 1B are left and right side views, respectively, of a selective fire firearm having a magazine attached thereto in accordance with one or more embodiments of the present disclosure.

An improved firearm, in accordance with one or more embodiments, has various different features that enhance the operation and use thereof. For example, a trigger group of a firearm may contain a trigger prop that props the rear of the trigger during automatic bursts such that, when the trigger is released, the propped trigger raises an open bolt sear to cease firing, but cannot engage a hammer of the trigger group (e.g., the propped trigger may be prevented from making contact with a hammer notch on the hammer). In this way, in a fully automatic mode, it can be assured that the bolt carrier group rests at the rear of the firearm (e.g., in the open bolt position) during a cease fire. By preventing the bolt carrier group from moving forward to the closed bolt position and chambering a cartridge into the heated barrel after a burst of fully automatic fire, possible cook off of cartridges may be prevented.

The trigger block (also referred to herein as a "trigger group") may be configured to keep the open bolt sear raised when the firearm is changed from a fully automatic mode to a safe mode (e.g., by rotating a selector from a fully automatic position to a safe position) so that the bolt carrier group remains in the open bolt position when the firearm is in safe mode. In the safe mode, the trigger prop may be retracted from under the rear end of the trigger so that the trigger sear rises up and engages the hammer notch on the hammer and the automatic sear may be retracted thereby allowing the hammer to rest on the trigger sear.

The trigger block may be configured such that, when the firearm is changed from the safe mode to a semi-automatic mode, the open bolt sear may be released, so that the bolt carrier group moves forward to the closed bolt position feeding a cartridge form the magazine into the chamber without firing it until the trigger is again pulled.

The selector may be arranged such that the safe mode position is located between the fully automatic mode position and the semi-automatic position. Because the bolt carrier moves forward when the selector is moved from the fully automatic mode position through the safe mode position to the semi-automatic mode position, a mechanism on the selector may be provided to further prevent cook off when changing to semi-automatic mode. For example, changing from the safe mode to the semi-automatic mode may require an extra step such as depressing a button on the selector, so as to increase the user's awareness of the risk of cook off, thereby increasing the likelihood that the user will consider whether such a change is appropriate.

The firearm upper receiver may have a forward assist which is used to force the bolt carrier assembly forward if it gets stopped out of battery. This forward assist button can be depressed, which forces a plunger forward that engages notches cut on the bolt carrier and forces the bolt carrier forward. When the firearm is in fully automatic open bolt operation, if the trigger is pulled and the bolt carrier assembly gets stopped before firing a round and the operator uses the forward assist to force the bolt carrier forward once the bolt carrier assemble reaches its locked position the round will fire whether the trigger is still pulled or not. Once the round fires, the bolt carrier will recoil rearward with high energy and force the depressed forward assist plunger rearward into the hand of the operator causing possibly injury.

A cover for the forward assist such as a snap-on plastic cover may be provided that prevents an operator from pushing the forward assist button. A snap-on cover of this type may be installed on the forward assist during fully automatic open bolt operation of the firearm to help prevent injury. The snap-on cover may be configured to be optionally used and easily installed and removed in just seconds.

According to an embodiment, the firearm may be compatible with large capacity magazines. For example, the firearm may be compatible with 60 and 100 round magazines. The firearm may be configured to withstand the heat associated with sustained fully automatic fire. The ability to ensure that the bolt carrier group rests in a rearward, open bolt position, following a burst of automatic fire is one aspect of how the firearm may withstand the heat associated with sustained fully automatic fire.

One type of firearm is discussed herein as an example, though the present disclosure may be applied to other known firearms. The firearm may be made in any desired caliber. For example, each type of firearm may be made in 5.56×45 mm NATO or 6.8×43 mm. Both 5.56×45 mm NATO and 6.8×43 mm may share components. For example, both 5.56×45 mm NATO and 6.8×43 mm may generally share all components except the barrel, bolt, and magazine for a given type of firearm.

Figure 1B:
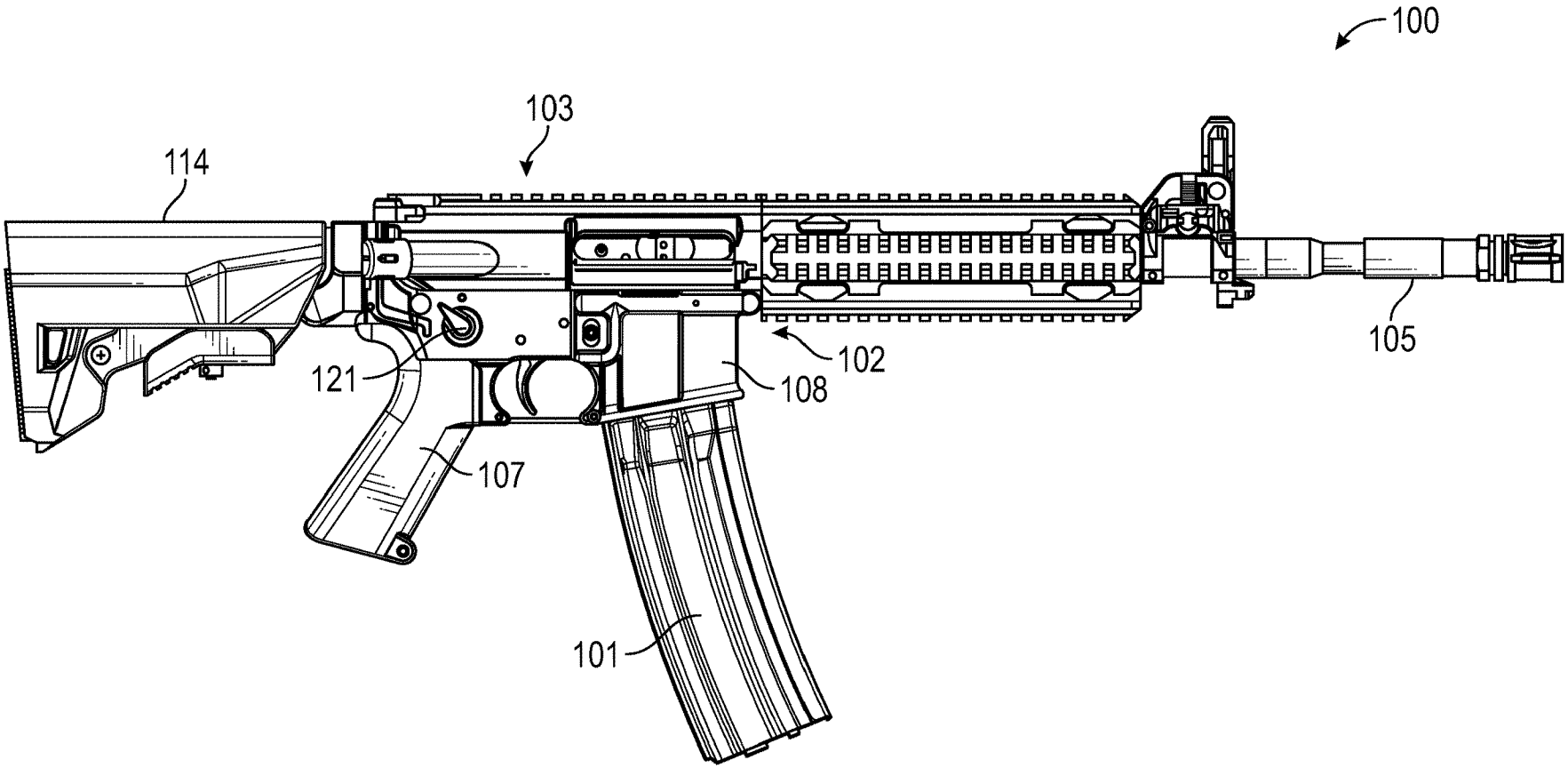

FIG. 1 shows a firearm 100, according to an embodiment. The firearm 100 is capable of fully automatic (full auto) and semi-automatic (semi-auto) fire as selected by the user (e.g., firearm 100 may be a selective fire firearm). As shown, firearm 100 may include a selection mechanism 121 (e.g., a selector) for selecting between the full auto and semi-auto modes and a safe mode in which firing of the firearm is prevented.

Firearm 100 may be configured to fire from an open bolt position during automatic fire and from a closed bolt position during semi-automatic fire. In this way, the accuracy of the firearm may be increased in the semi-automatic mode and the risk of cook off may be reduced in the full auto mode.

The firearm may include an upper receiver group 103 that consists of barrel 105, a gas system, a sight assembly, a handguard, and an optional grip 106. The lower receiver 102 of firearm 100 may consist of the trigger group, grip 107, and magazine well 108. Firearm 100 may have a stock 114, which may contain the receiver extension for the recoil buffer, main (e.g., buffer) spring, and bolt carrier group. The firearm 100 may have a magazine, e.g., magazine 101, attached thereto. Magazine 101 may be, for example, a 60-round or 100-round magazine such as those sold by SureFire, LLC of Fountain Valley, Calif.

One or more embodiments provide a magazine fed, gas operated auto cycling firearm which operates generally as follows. Like all breech loading repeaters, the firearm must perform eight ammunition handling functions between one shot and the next. The firearm may feed, chamber, lock, fire, unlock, extract, eject the ammunition cartridge and cock the gun ready for the next cycle. The bolt group is involved in all eight of these functions. As a main spring drives the bolt group forward, the bolt group completes the feed by pushing the top cartridge forward out of the magazine and tilting the forward bullet end up a feed ramp and into the barrel chamber. The bolt head is rotated using a cam to lock the bolt head and the cartridge into the barrel, then, successively, firing the cartridge and completing the forward moving half of the bolt cycle.

As the bullet moves through the barrel, the bullet passes a gas port hole drilled in the barrel wall through which high pressure gas enters the cylinder and drives the piston rearward (or if the bolt carrier contains the cylinder, the gas acts directly on the bolt carrier), thus throwing the bolt carrier rearward and compressing the main spring. During the bolt carrier's first rearward motion a helical cam in the carrier rotates the bolt to unlock the bolt head from the barrel and then pulls the bolt rearward for the rest of the combined rearward cycle. An extractor claw on the bolt head pulls the fired cartridge case from the barrel chamber and an ejector strikes or pushes on the cartridge base opposite the extractor, pivoting the cartridge around the extractor and out through an eject port in the gun structure. The combined bolt head and bolt carrier's continued rearward motion uncovers the new top cartridge in the magazine which feeds it upward at least partially into the bolt head's return path while the rearward moving carrier and bolt cocks the spring loaded firing hammer and moves beyond (rearward of) a bolt stop, which is lifted up by the magazine follower after the last cartridge has fed from the magazine and which catches and holds the bolt and carrier group rearward so that the empty magazine may then be removed and replaced with a full one ready to resume fire without hand cocking the gun. A cocking handle, or a charging handle, may be provided in case of a misfire or other cycle malfunction.

Figure 2A:
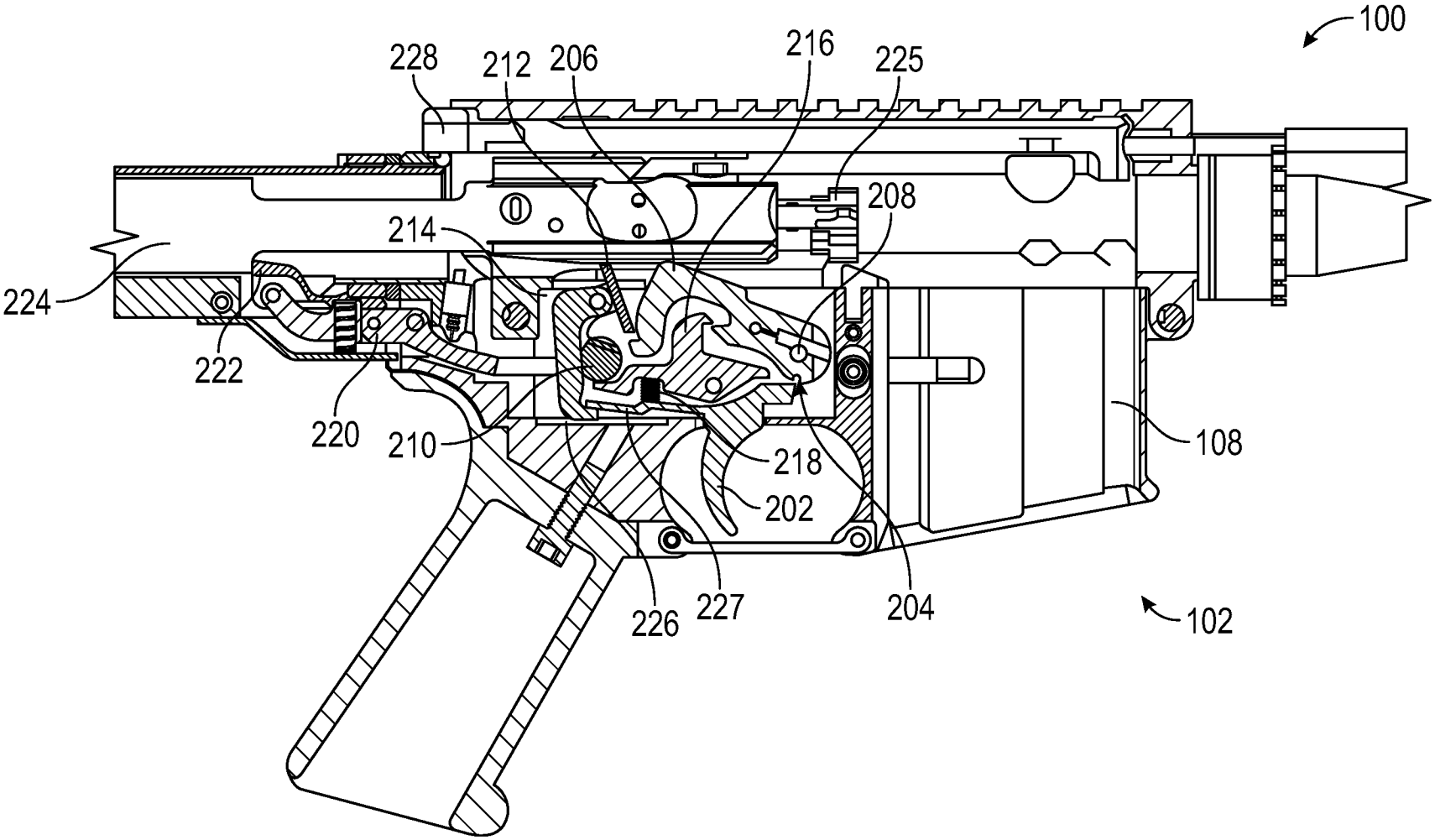
FIG. 2A is a cross-sectional side view of a lower receiver assembly of the firearm of FIG. 1 in fully automatic open bolt mode according to an embodiment.

FIG. 2A is a cross-sectional side view of a portion of the receiver of firearm 100. The lower receiver assembly 102 includes the trigger group of firearm 100. The trigger group may include trigger 202 with trigger sear 204, a trigger spring (not shown), hammer 206 having a hammer notch 208, a hammer spring (not shown), selector mechanism 210, automatic sear 212, trigger prop 214, an automatic sear spring (not shown), disconnect 216, and disconnect spring 218. During automatic fire, the trigger works in conjunction with open bolt sear arm 220, open bolt sear 222, and other individual components as discussed herein.

The trigger group may be a drop-in trigger assembly, according to an embodiment. The trigger block assembly may be assembled outside of the firearm 100. Once assembled, the trigger block assembly may be dropped into place in lower receiver 102.

The receiver assembly also houses the bolt carrier 224 and bolt 225, charging handle 228 as well as other components found in contemporary assault rifle receivers, such as, for example, an ArmaLite® rifle (AR) receiver. In one embodiment, a charging handle 228 may be slidably disposed in the upper receiver of the rifle to facilitate cocking of firearm 100 by pulling bolt carrier 224 rearward.

In an embodiment of the present disclosure, rotating the selector to the AUTO OB position does not cock the cycling weights (e.g., bolt carrier group and/or buffer) rearward to open bolt position; therefore, the user may either use the charging handle 228 to move the weights rearward or immediately fire such that the first shot is fired from the closed bolt position. For example, until a first shot is fired in a fully-automatic open bolt (AUTO OB) mode (e.g., after operating the firearm in the semi-auto mode), the first shot may be fired from a closed bolt position. On the first trigger pull for firing a full auto burst, the trigger prop spring may cause foot 226 of trigger prop 214 to swing forward under the rear portion 227 of trigger 202. Foot 226 then props the rear of trigger 202 up at a position that prevents trigger sear 204 from engaging/holding hammer notch 208/hammer 206 while still allowing automatic sear 212 to be raised. Therefore, hammer 206 may be held by automatic sear 212 and bolt carrier 224 may be held by open bolt sear 222 in an open bolt position when trigger 202 is released at the end of the full auto burst. Thus, the first burst of fire may begin from the closed bolt position and stop in the open bolt position, and all subsequent bursts of fire start and end in the open bolt position. A method of operating the firearm while in the fully automatic open bolt mode of operation may therefore include firing a first fully automatic burst from a closed bolt configuration; stopping the first fully automatic burst in an open bolt configuration; and firing a subsequent fully automatic burst from the open bolt configuration.

For example, for shots fired from the open bolt position, trigger 202 may be pulled back by the user resulting in the raising of open bolt sear arm 220, which lowers open bolt sear 222. This lowering of the open bolt sear 222 allows bolt carrier 224 to be released and move forward due to the buffer and buffer spring. The forward moving bolt chambers a live round from the magazine and the breech is locked by the bolt while automatic sear 212 is tripped by the back of bolt carrier 224. When automatic sear 212 is tripped, hammer 206 is released by tripped auto sear 212 and strikes the firing pin inside bolt 225 and thus a round is fired, lugs of the barrel and bolt 225 unlock, and bolt carrier 224 travels rearward riding over hammer 206 and reengaging a top hammer notch with auto sear 212.

The cycle is repeated as the main spring pushes bolt carrier 224 forward again unless trigger 202 is released to raise open bolt sear 222 to catch bolt carrier 224 or until magazine 101 is empty. If trigger 202 is released mid-fire, open bolt sear 222 is allowed to rise and hold bolt carrier 224 to the rear of the firearm 100 while the trigger prop foot 226 prevents the trigger from being released to a position in which the trigger or the disconnect catches hammer 206. In this way, it can be ensured that the last chambered round in full auto mode is always fired before the bolt carrier is caught by the open bolt sear. As understood by one skilled in the art, the extraction and ejection of the case are the same as done by contemporary AR platforms.

Figure 2B:
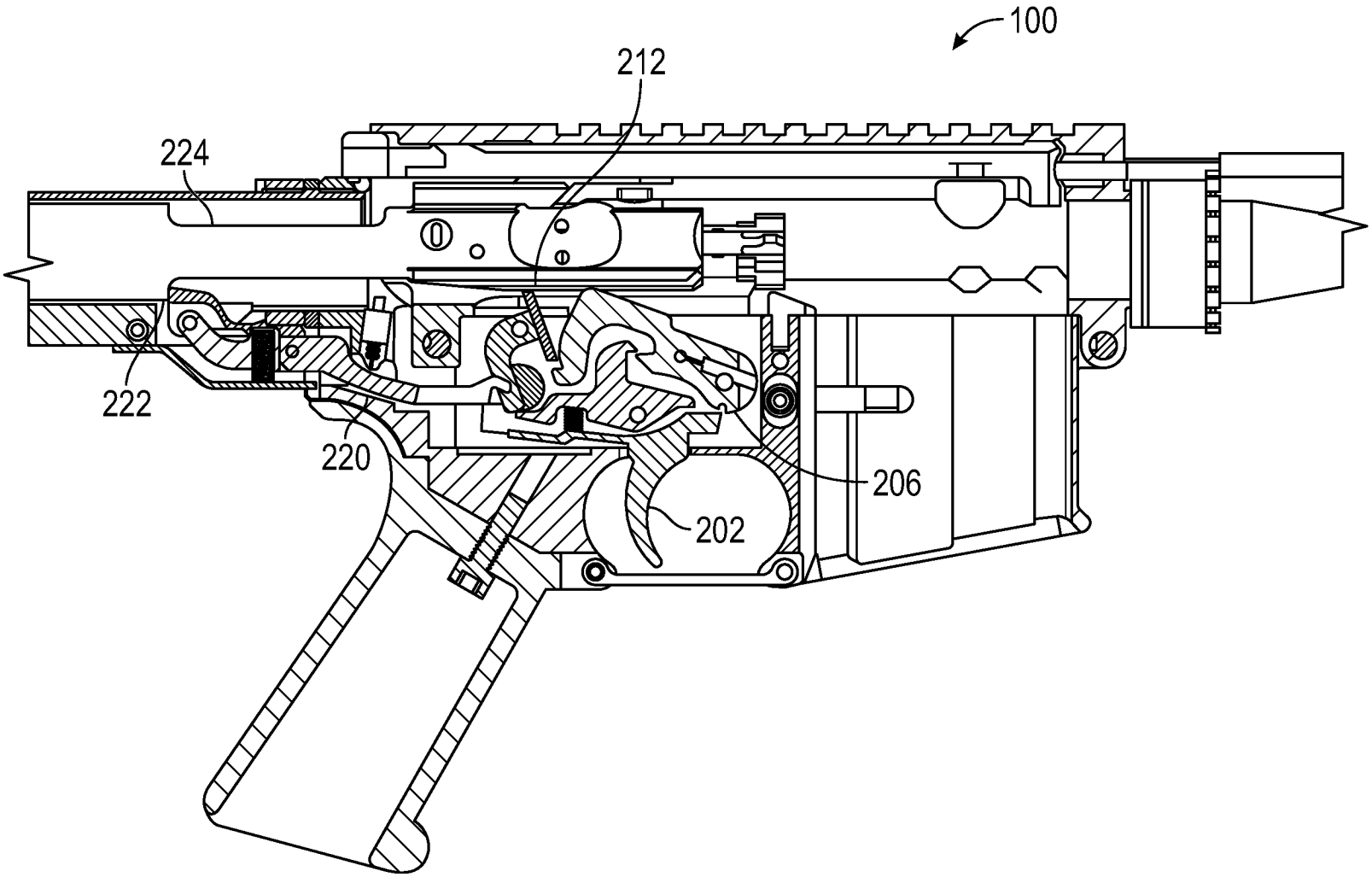
FIG. 2B is a cross-sectional side view of a lower receiver assembly of the firearm of FIG. 1 implemented without a trigger prop in fully automatic open bolt mode according to an embodiment.

FIG. 2B is a cross-sectional side view of a portion of the receiver of firearm 100 showing how automatic sear 212 and lower receiver assembly 102 may be provided without a trigger prop in one embodiment.

Figure 3:
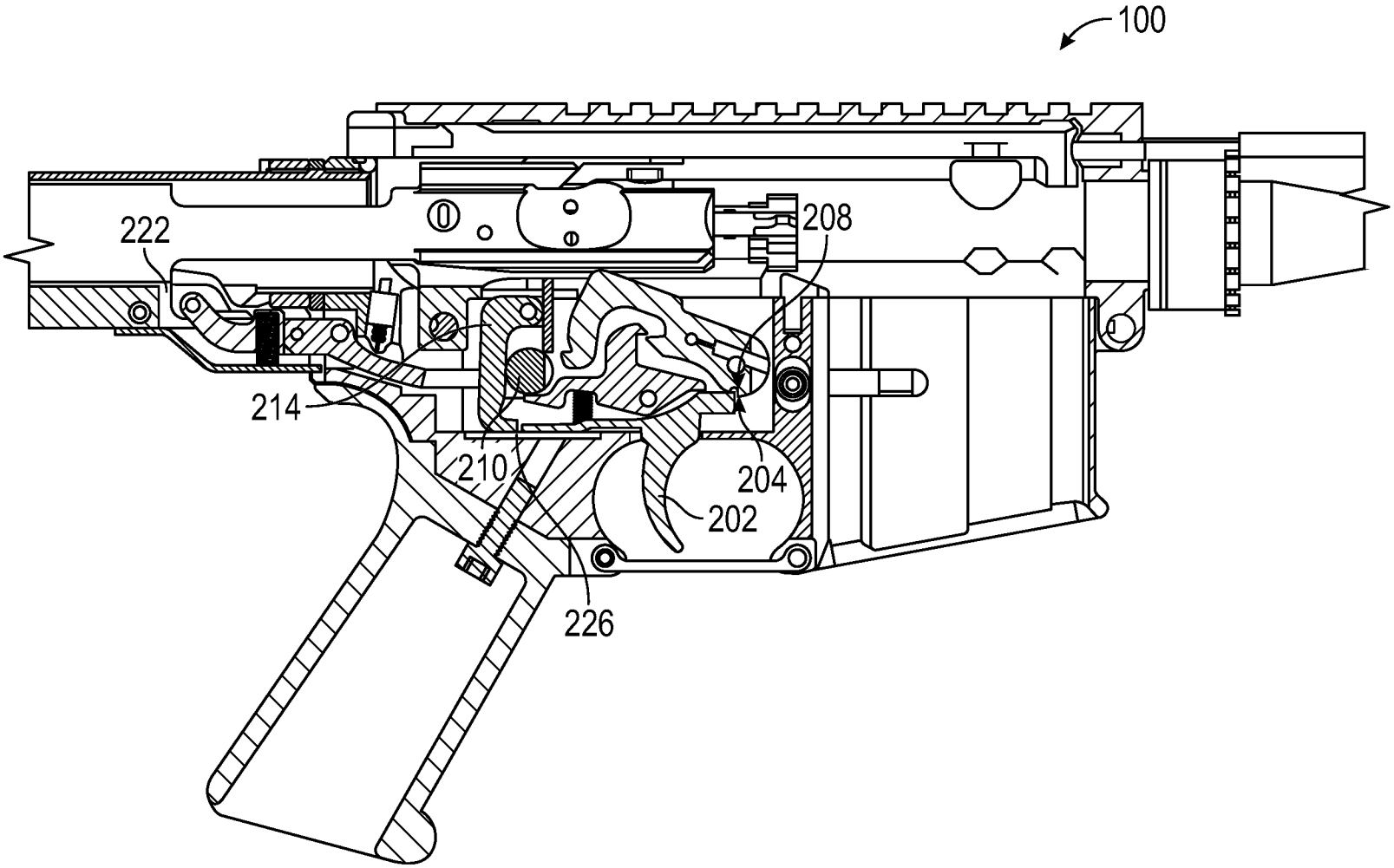
FIG. 3 is a cross-sectional side view of the lower receiver assembly of the firearm of FIG. 1 in safe mode according to an embodiment.

In an embodiment of the present disclosure, FIG. 3 shows a cross-sectional view of the receiver assembly of firearm 100 having a trigger prop when selector mechanism 210 (e.g., an interior structure of selector 121 of FIG. 1) has been moved from an AUTO OB position to a safe mode or SAFE position. As shown, selector mechanism 210 may be configured such that, when the selector is moved from the AUTO OB position to the SAFE position, the selector first moves the trigger prop foot 226 rearward from under the rear portion 227 of trigger 202 which allows the trigger sear 204 to rise up and engage the hammer notch 208. The selector mechanism 210 then retracts the automatic sear (auto sear) 212 which holds the hammer 206 during full-auto fire and allows the hammer 206 to rest on the trigger sear 204.

Once the selector is in the SAFE position, the bolt carrier 224 is still in an open bolt position and the selector mechanism 210 can be moved either back to open bolt full-auto position or to a closed bolt semi-auto (SEMI CB) position. If the selector mechanism 210 is rotated to the SEMI CB position it releases the open bolt sear 222 so the bolt assembly moves forward feeding a cartridge from the magazine into the chamber without firing it until the trigger 202 is again pulled firing semi-auto closed bolt.

Figure 4:
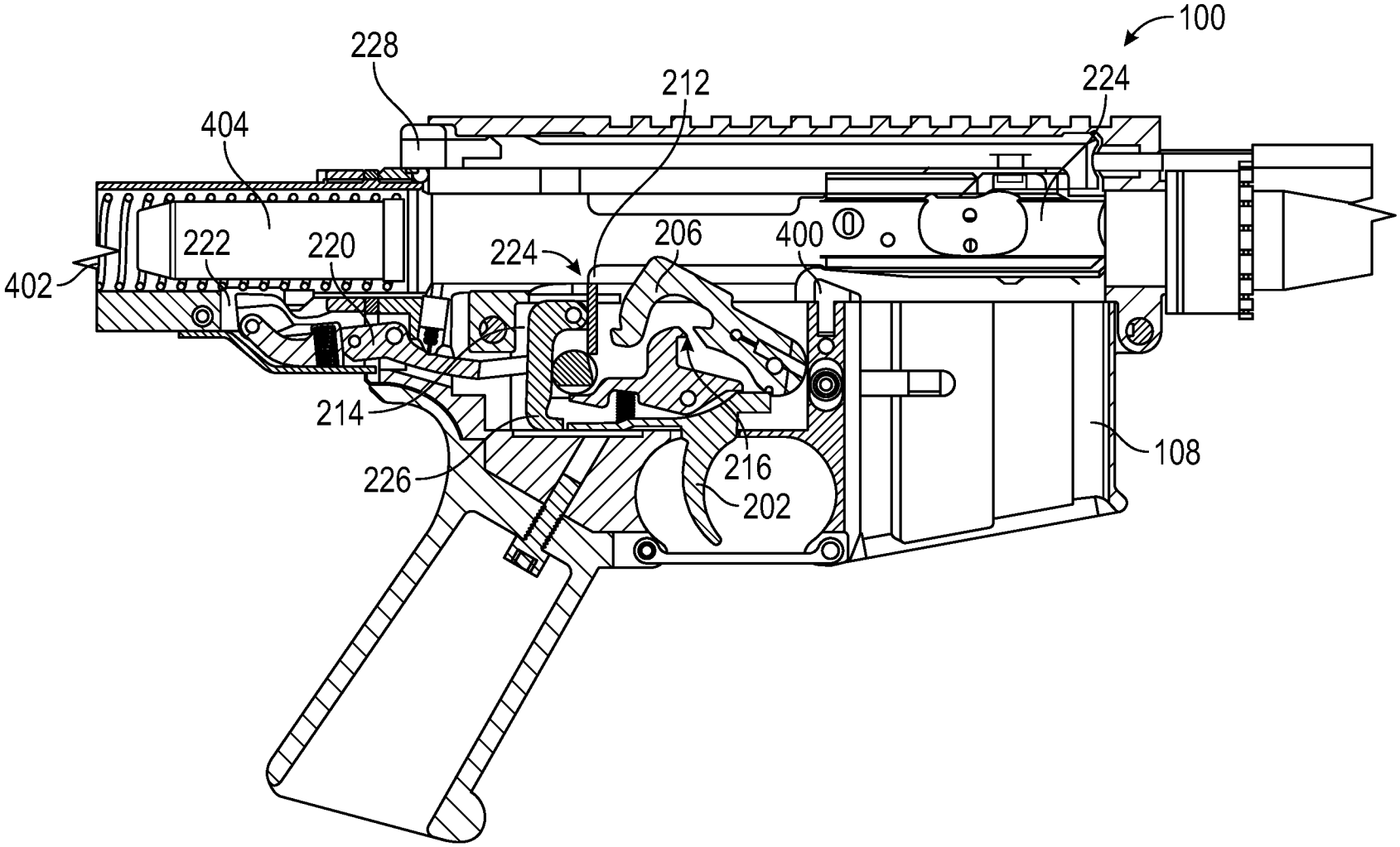
FIG. 4 is a cross-sectional side view of the lower receiver assembly of the firearm of FIG. 1 in semi-automatic closed bolt mode according to an embodiment.

FIG. 4 illustrates firearm 100 in SEMI CB mode. In semi-auto fire mode, firearm 100 may operate the same as a conventional AR firing semi-auto from a closed bolt. For example, when selector mechanism 210 is moved from AUTO OB through SAFE to SEMI CB (semi-automatic closed bolt), selector mechanism 210 disengages trigger prop 214, automatic sear 212, and open bolt sear 222, and allows disconnect 216 to operate as would be understood by one skilled in the art. For example, disconnect 216 engages the underside of hammer 206 after each round is fired, and may release hammer 206 once trigger 202 is released and trigger sear 204 engages hammer notch 208. FIG. 4 shows bolt 225 when in battery and the lugs are locked to provide a closed breech and loaded chamber. As shown in FIG. 4, hammer 206 is engaged by trigger 202. When trigger 202 is pulled, hammer 206 is released and may travel through the opening in the bolt carrier to strike the back of the firing pin, thus firing a round. The bolt carrier may then travel rearward, compressing main spring 402 and pushing buffer 404. The force of spring 402 and buffer 404 may then push the bolt carrier group forward again, chambering a new round and resting in closed bolt position. As shown in FIG. 4, in SEMI CB mode, open bolt sear 222 is held down and does not affect the motion of bolt carrier 224. Bolt catch 400 may hold bolt 225 after the final round is fired.

The hammer may be an aluminum hammer having a steel face. The hammer may be all steel. The hammer may be comprised of aluminum, titanium, steel, or any combination thereof. The hammer may be made of any desired material.

The hammer may be hard anodized where the bolt carrier slides against the hammer. The hammer may be hardened or treated as desired where the bolt carrier slides against the hammer or on any other part or surface thereof.

Figure 5:
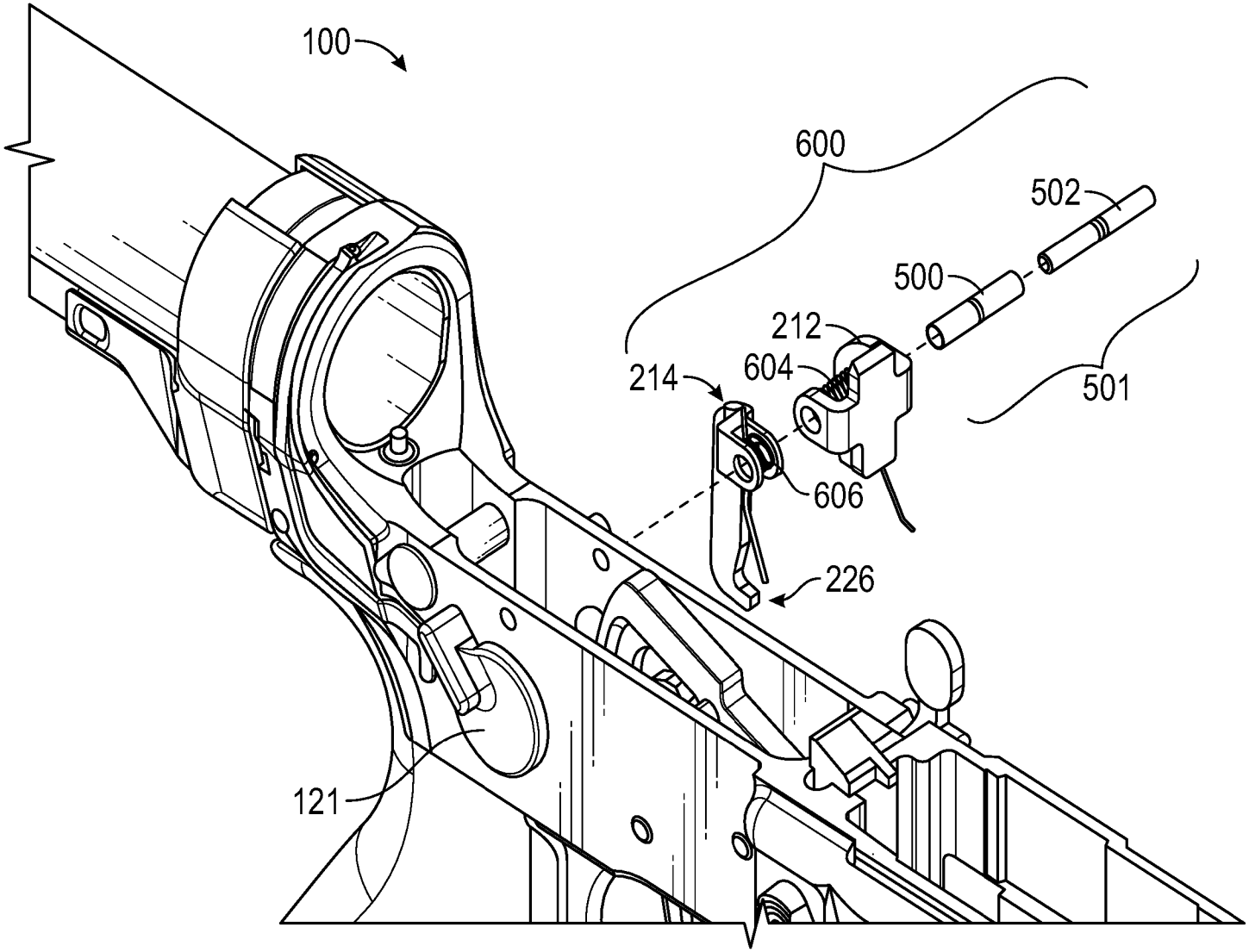
FIG. 5 is an exploded perspective view of a trigger prop assembly of the firearm of FIG. 1 according to an embodiment.

FIG. 5 shows an exploded view of a trigger prop assembly 600 including trigger prop 214 and auto sear 212 for firearm 100 according to an embodiment. As shown in FIG. 5, trigger prop assembly 600 may include trigger prop 214 and auto sear assembly 501. As shown, auto sear assembly 501 may include auto sear 212, axel 500, and pin 502. As shown in FIG. 5, trigger prop 214 may have a trigger prop spring 606 that biases trigger prop 214 into various positions based on the position of selector 121 as described herein. Auto sear 212 may include an auto sear spring 604 that biases auto sear 212 into various positions based on the position of selector 121 (a selector mechanism 210) as described herein.

Figure 6A:
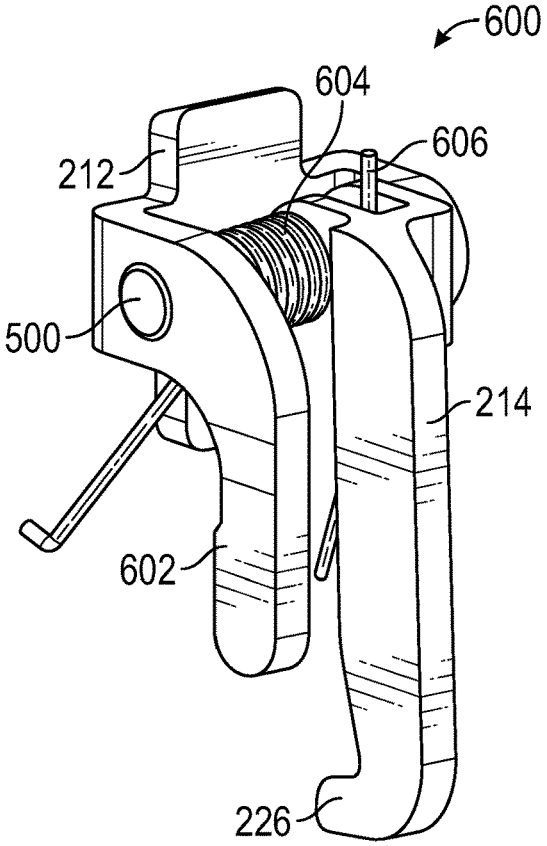
FIGS. 6A and 6B are assembled views of the trigger prop assembly of the firearm of FIG. 1 according to an embodiment.

FIG. 6A shows a perspective view of trigger prop assembly 600 in an assembled configuration. As shown in FIG. 6A, when trigger prop assembly 600 is assembled, axel 500 may extend through openings in auto sear 212, trigger prop 214, auto sear spring 604, and trigger prop spring 606 so that auto sear 212 and trigger prop 214 can be independently or jointly biased about axel 500. As shown, trigger prop foot 226 may extend beyond an extended leg 602 of auto sear 212. In this way, trigger prop assembly 600 may be configured so that, when selector 121 is moved from an AUTO OB position to a SAFE position, the trigger prop foot 226 can be moved rearward from under the trigger and then the automatic sear 212 can be retracted.

Figure 6B:
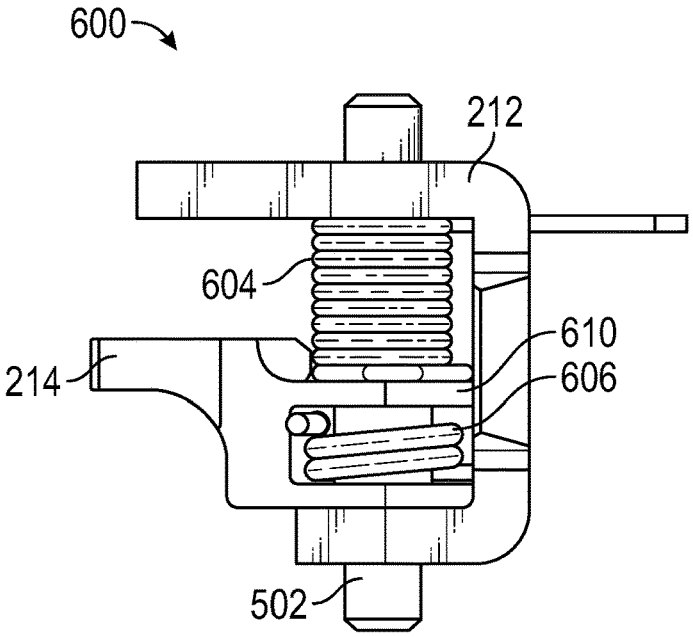

FIG. 6B shows a top view of trigger prop assembly 600 showing how pin 502 may extend from opposing sides of trigger prop assembly 600 (e.g., for mounting of assembly 600 within the trigger block of firearm 100). It can be seen in the example of FIG. 6B that a portion 610 of trigger prop 214 that wraps around axle 500 may separate the trigger prop spring 606 from the auto sear spring 604.

Figure 7A:
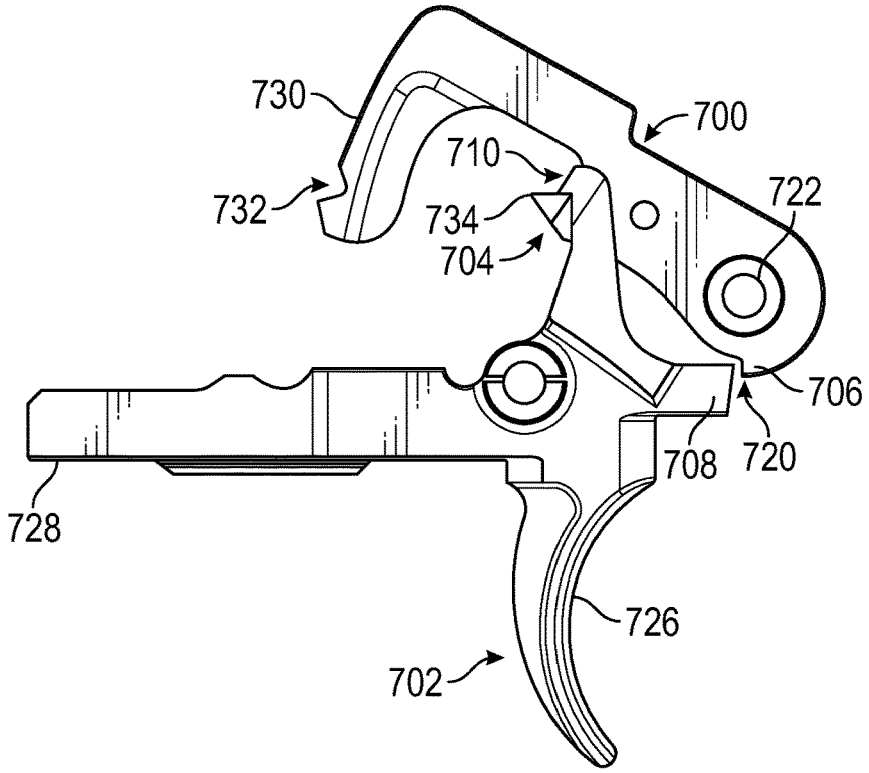
FIG. 7A is a side view of a hair trigger assembly that includes a dual use trigger according to an embodiment.

In accordance with one or more embodiments of the present disclosure, a trigger for a firearm such as firearm 100 may be provided that can be used as a standard trigger or a light pull trigger (sometimes referred to as a hair trigger or a Marksmen® trigger) by changing the hammer used in conjunction with the trigger. FIG. 7A shows an example of a dual use trigger configured for use with multiple hammers in accordance with an embodiment.

As shown in FIG. 7A, a dual use trigger such as trigger 702 may include both a trigger sear 708 (standard pull) and light pull sear 710. In the example of FIG. 7A, trigger 702 is implemented with a light pull hammer 700 to form a light pull trigger assembly. Light pull hammer 700 may have hammer post 704 that engages with a light pull sear 710 of dual use trigger 702. Hammer post 704 of light pull hammer 700 may be located further away from the hammer pivot 722 than the location of a standard hammer notch, thereby increasing the moment arm of trigger 702 and reducing the amount of force on surface 726 required to release hammer 700, thus, creating a lighter trigger pull.

Light pull hammer 700 may include a cutaway portion 706 that provides clearance 720 with trigger sear 708 at the location where a standard hammer notch would be located to prevent trigger sear 708 from engaging hammer 700. In various embodiments, trigger 702 may be implemented in a firearm having a trigger prop that props rear portion 728 of trigger 702 in a full auto mode or may be implemented in any other suitable firearm. Light pull hammer 700 may include an extended portion 730 having a notch 732 configured to engage an auto sear in some modes of operation as would be understood by one skilled in the art. Hammer post 704 may be configured to engage light pull sear 710 of trigger 702 on a first side of the hammer post and to engage, in some modes of operation, a disconnect on a second opposing side 734 of the hammer post.

Figure 7B:
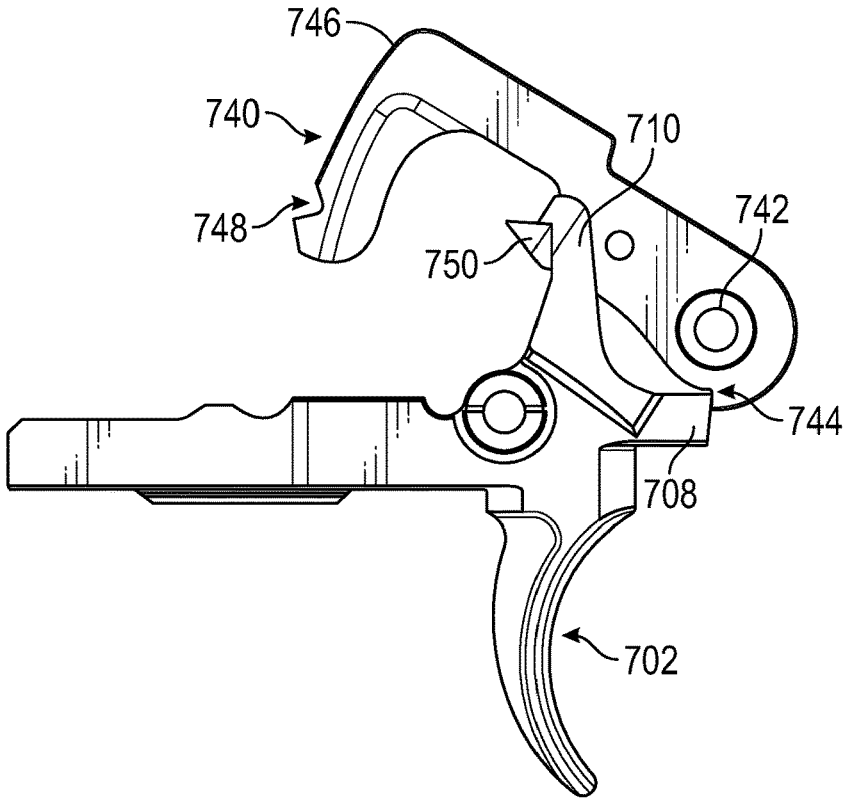
FIG. 7B is a side view of a standard pull trigger assembly that includes a dual use trigger according to an embodiment.

As shown in FIG. 7B, dual user trigger 702 may be alternatively implemented with a standard hammer 740 having a hammer notch 744 that engages trigger sear 708 at a location relatively closer to its hammer pivot 742 than light pull sear 710. Standard hammer 740 may include an extended portion 746 having a notch 748 for engaging an auto sear in some modes of operation and may include a portion 750 for engaging a disconnect in some modes of operation.

Figure 8B:
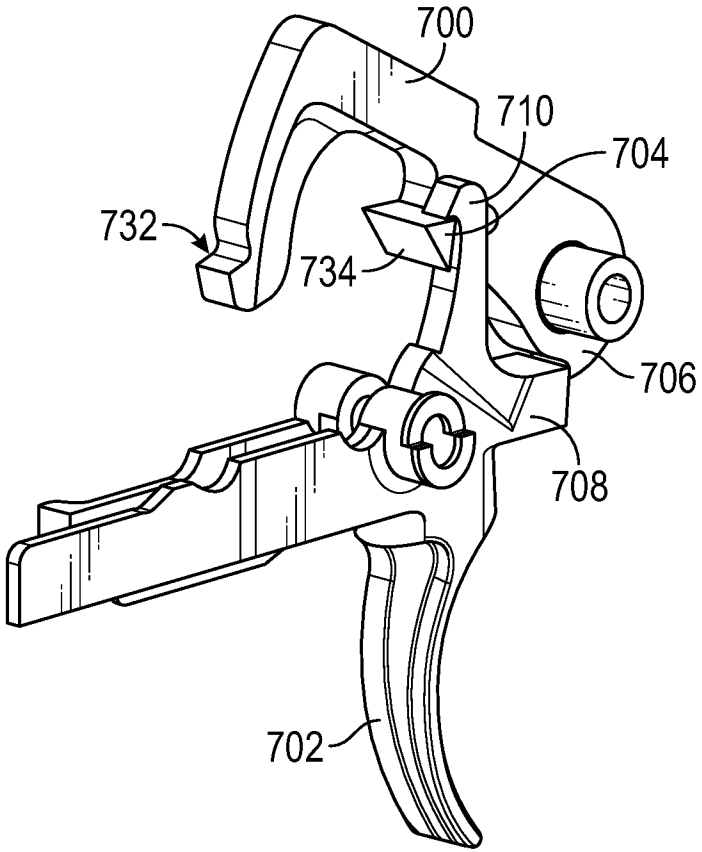
FIG. 8B shows a perspective view of the hair trigger assembly of FIG. 7A according to an embodiment.
Figure 8A:
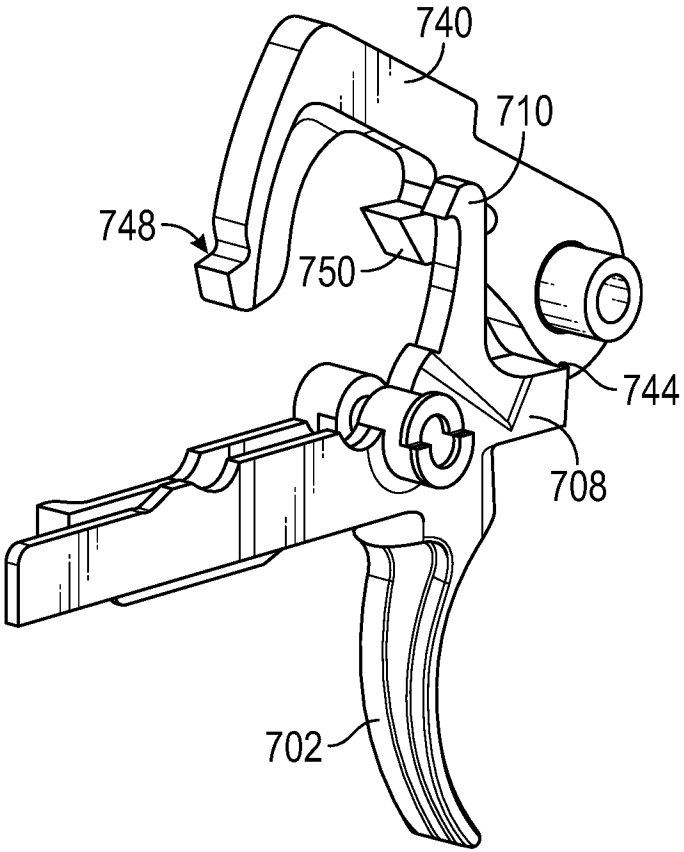
FIG. 8A shows a perspective view of the standard pull trigger assembly of FIG. 7B according to an embodiment.

FIG. 8A is a perspective view of the assembly shown in FIG. 7B showing how portion 750 of standard hammer 740 does not engage light pull sear 710 of trigger 702 thereby allowing trigger sear 708 and hammer notch 744 to control the release of hammer 740 when trigger 702 is pulled. FIG. 8B is a perspective view of the assembly of FIG. 8A showing how hammer post 704 of hammer 700 extends beneath light pull sear 710 of trigger 702 to engage light pull sear 710 and control the release of hammer 700.

Hammer 740 may be exchanged for hammer 700 as desired by the user to allow for a lighter trigger pull. Because trigger 702 is configured to operate with both hammers 700 and 740, a firearm including trigger 702 may be converted from a standard pull weight to a light pull weight by replacing only the hammer and no other parts may require alteration and/or removal to change the hammer (unlike if the trigger was to be changed) and, thus, the pull weight may be changed with, for example, a standard cartridge as the tool.

As discussed herein, according to an embodiment, a selector mechanism can be used to select between modes of operation for a firearm such as firearm 100 (e.g., to select between an AUTO OB mode, a SAFE mode, and a SEMI CB mode). The selector may be a button, slider, rotary, switch, and/or other mechanism, as would be understood by one skilled in the art.

The selector mechanism can be configured such that changing the selection between the AUTO OB mode, SAFE mode, and/or SEMI CB mode merely involves moving a selector lever. However, in some embodiments, the selector mechanism can be configured such that changing the selection from open bolt (e.g., AUTO OB) to closed bolt (e.g., SEMI CB) requires an extra step. For example, changing the selection from open bolt to closed bolt can require that a button be depressed. The button can be part of the selector switch or can be separate therefrom. For example, the button can be in the middle of the selector switch.

Requiring that an extra step be performed in order to change from open bolt operation to closed bolt operation helps to assure that proper consideration is given regarding the propriety of this change. As those skilled in the art will appreciate, changing from open bolt operation to closed bolt operation can result in a dangerous cook off if a round is chambered while the chamber is hot. For example, a cook off can occur if a round is chambered before the chamber has cooled adequately after sustained rapid firing of the firearm. Cook offs are not likely to occur during open bolt operation since the cartridge is fired as soon as it is chambered. Thus, this extra step when changing from open bolt operation to closed bolt operation is a desirable safety feature. The extra step can cause a user to more carefully consider whether or not the chamber has had adequate time to cool.

Figure 9:
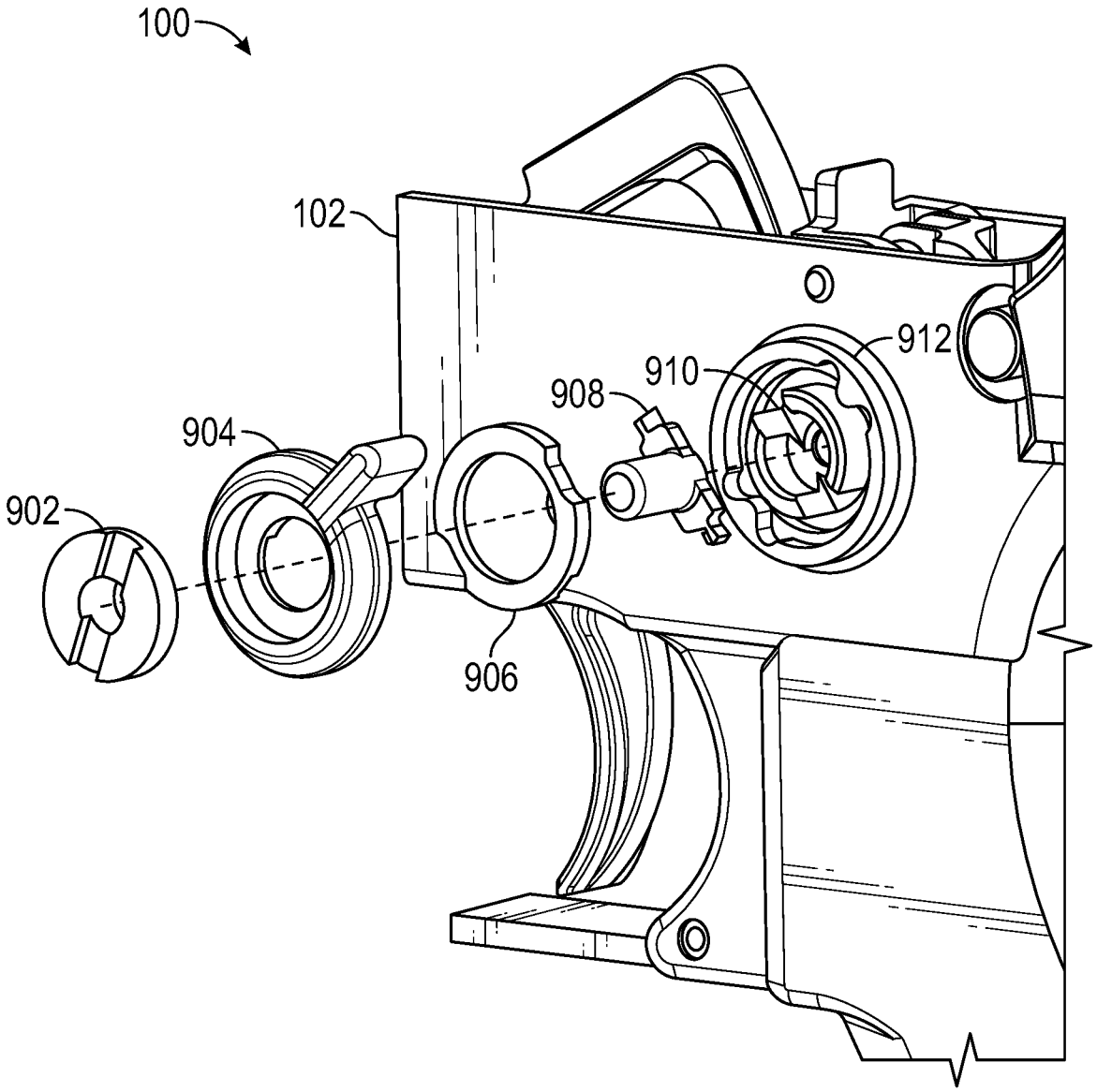
FIG. 9 is an exploded front perspective view of a risk button assembly for a selective fire firearm according to an embodiment.
Figure 10:
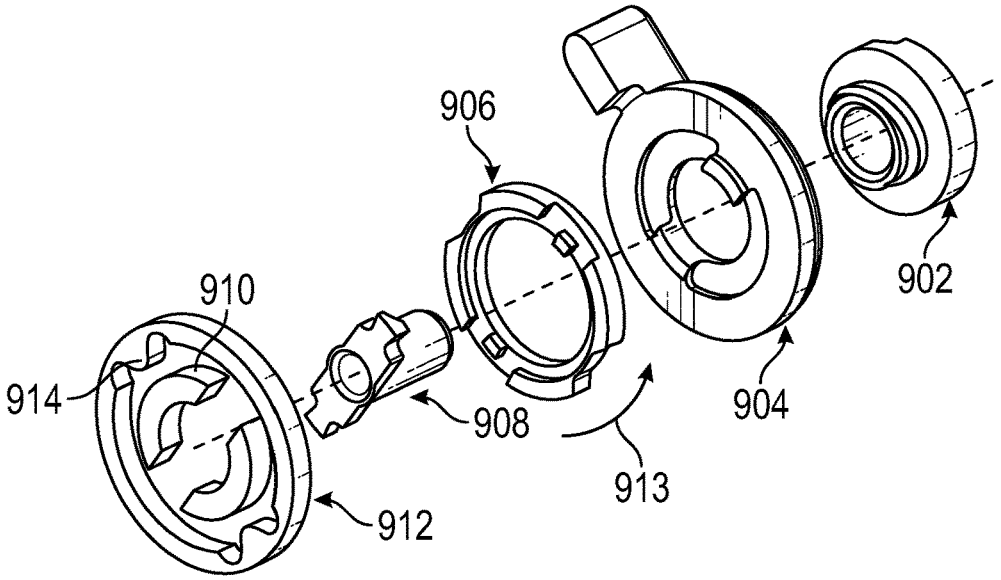
FIG. 10 is an exploded rear perspective view of the risk button assembly of FIG. 9 according to an embodiment.
Figure 11:
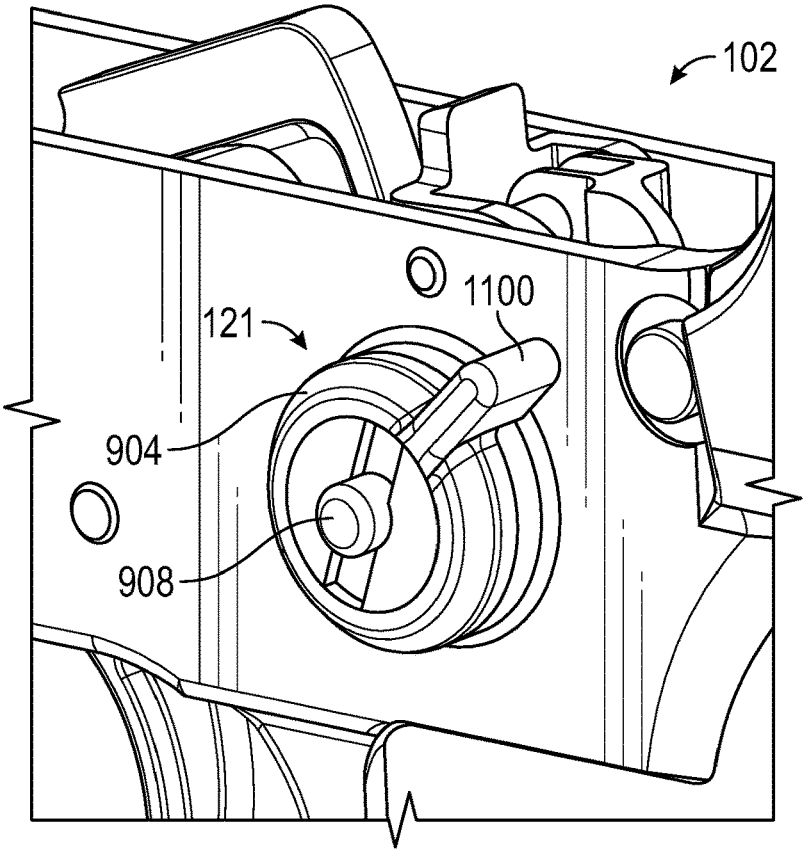
FIG. 11 is a perspective view of portion of a firearm having a risk button assembly according to an embodiment.

FIG. 9 shows a front exploded perspective view of a selector that requires an activator, such as a button push, to change from AUTO OB mode to SEMI CB mode. The exemplary activator illustrated in FIG. 9 is a risk button assembly that may include a fastener 902, an ambidextrous selector 904, a limited motion disk 906, a risk button plunger 908, a selector member 910 and a receiver boss 912. The risk button assembly may also include a bias spring (not shown). FIG. 10 shows a rear exploded perspective view of fastener 902, ambidextrous selector 904, limited motion disk 906, risk button plunger 908, selector member 910 and receiver boss 912 having lobes 914. FIG. 11 is a perspective view of a receiver 102 implemented with a selector 121 having an assembled risk button assembly and showing how risk button plunger 908 may be disposed centrally within ambidextrous selector 904. Knob 1100 on ambidextrous selector may be pushed or pulled by a user to switch between AUTO OB, SAFE and SEMI CB operating modes for the firearm. However, the risk button assembly may be configured such that, to move selector 121 from the SAFE mode position shown in FIG. 11 to SEMI CB mode, risk button plunger 908 must be pushed (e.g., using a user's finger, a bullet, or a magnet) if the selector was previously at or near the AUTO OB position. The risk button assembly may be configured such that the risk button does not stop the operator from going back and forth between either firing mode or SAFE nor does it prevent the operator from going from semi-auto to full auto, but only causes the operator to decide whether to risk a semi-auto cook off.

Figure 12:
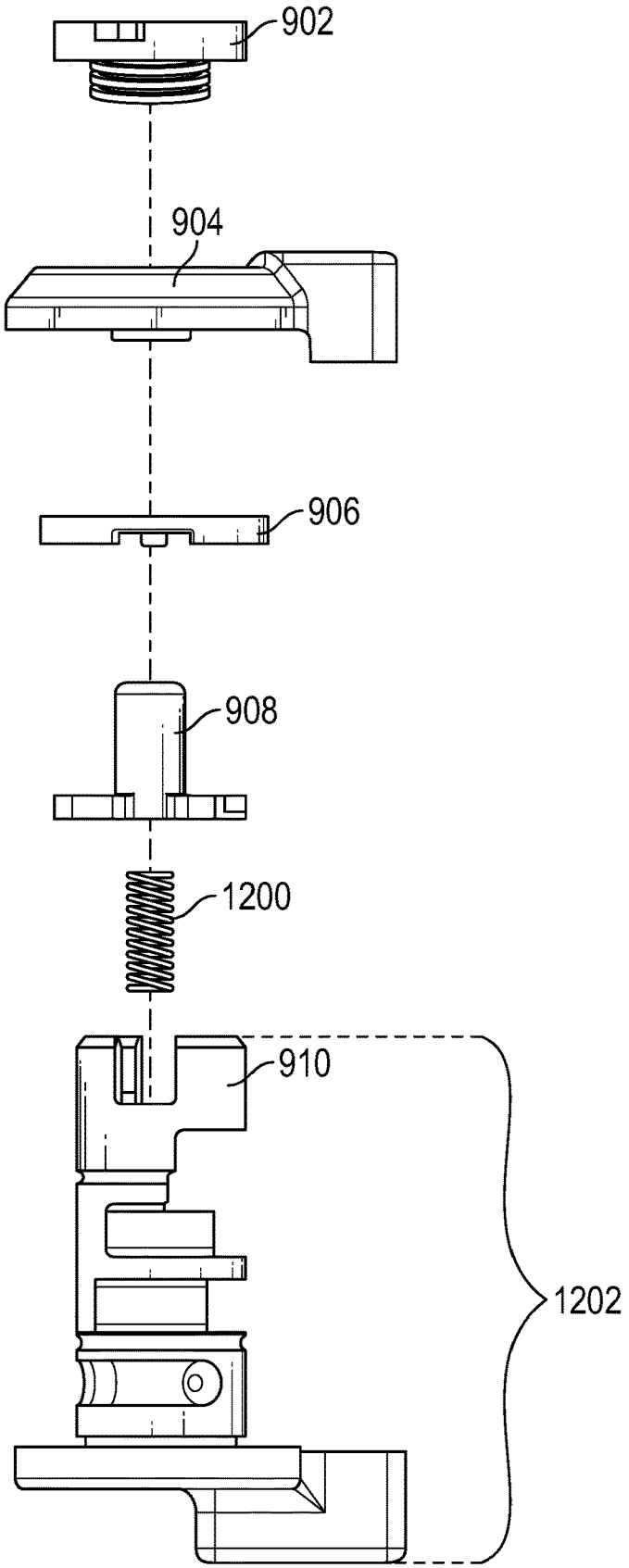
FIG. 12 is an elevational exploded side view of a risk button assembly according to an embodiment.

FIG. 12 is an elevational exploded view of the risk button assembly showing additional portions of selector mechanism 1202 of which selector member 910 forms a part and that extend into receiver 102 to arrange the trigger, disconnect, auto sear, open bolt sear, and hammer for various modes of operation as described herein. FIG. 12 shows a risk button spring 1220 that may be disposed between selector mechanism 1202 and plunger 908 to bias plunger 908 outward and to allow compression of plunger 908 to move to a closed bolt mode of operation.

Figure 13:
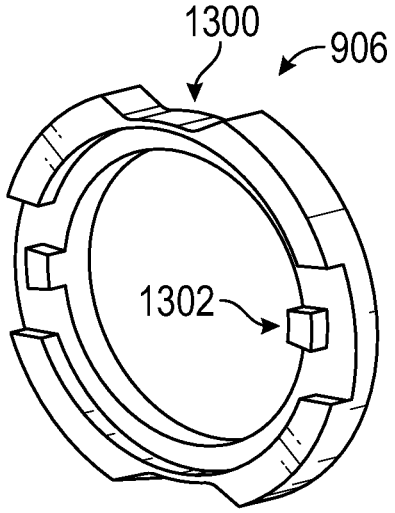
FIG. 13 is a perspective view of a limited motion disk of the risk button assembly of FIG. 10 according to an embodiment.
Figure 14:
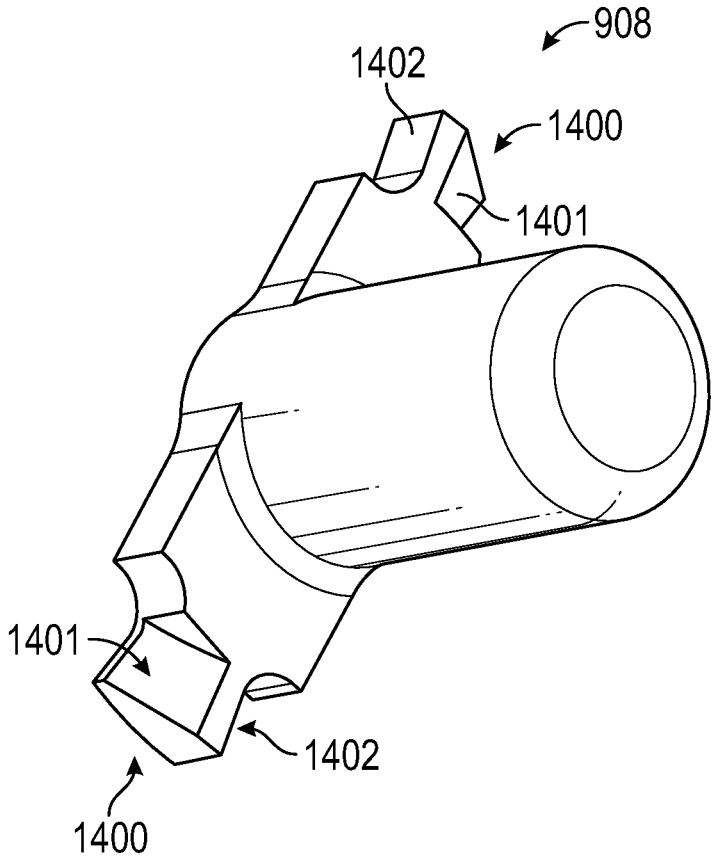
FIG. 14 is a perspective view of a risk button plunger of the risk button assembly of FIG. 10 according to an embodiment.

FIG. 13 is a perspective view of limited motion disk 906. As shown in FIG. 13, limited motion disk 906 may be symmetric and may contain a set of limited rotation tracks 1300 and limited rotation blocks 1302. FIG. 14 is a perspective view of risk button plunger 908. As shown in FIG. 14, risk button plunger may include two tabs 1400 that extend outward from a central button portion and guide on the limited motion disk 906. Each tab 1400 may include a ramp 1401 on one side and a perpendicular face 1402 (sometimes referred to as a "block") on an opposing side. When the selector is rotated from SEMI CB towards SAFE, the ramps 1401 on the risk button plunger 908 engage the limited rotation blocks 1302 on the limited motion disk 906 and start depressing the risk button plunger 908. When the selector is in the SAFE position, the selector can be moved back to SEMI CB without a push of plunger 908. However, if the selector is moved further towards AUTO OB it will pass the limited rotation blocks 1302 on the limited motion disk 906 and risk button plunger 908 will have to be depressed to return to the SEMI CB position.

When the selector is in the AUTO OB position and rotated to the SAFE position, the blocks 1402 on the risk button plunger 908 engage the limited rotation blocks 1302 and start to rotate the limited motion disk 906 until it reaches the SAFE position. From the SAFE position, if the operator attempts to continue to rotate the selector towards the SEMI CB position, the limited rotation tracks 1300 on the limited motion disk 906 will engage the lobes 914 on the receiver boss 912 and will prevent any further rotation of the selector until the risk button plunger 908 is depressed to disengage the blocks 1402 on the risk button plunger 908 from the limited rotation blocks 1302 on the limited motion disk 906.

In this way, the ramps 1401 and blocks 1402 may allow the selector to rotate in one direction but block it from rotating in the other, while the limited rotation tracks 1300 allow the selector to be moved into SAFE position from either firing mode and back to the firing mode from which it came without requiring a depression of plunger 908.

In some embodiments, the assembly can have a torsion spring (not shown) to bias the limited motion disk in a clockwise direction (e.g., as indicated by arrow 913 of FIG. 10) to ease operation of the risk button so that when the risk button plunger is depressed, the selector does not need to be rotated at the same time.

Figure 15:
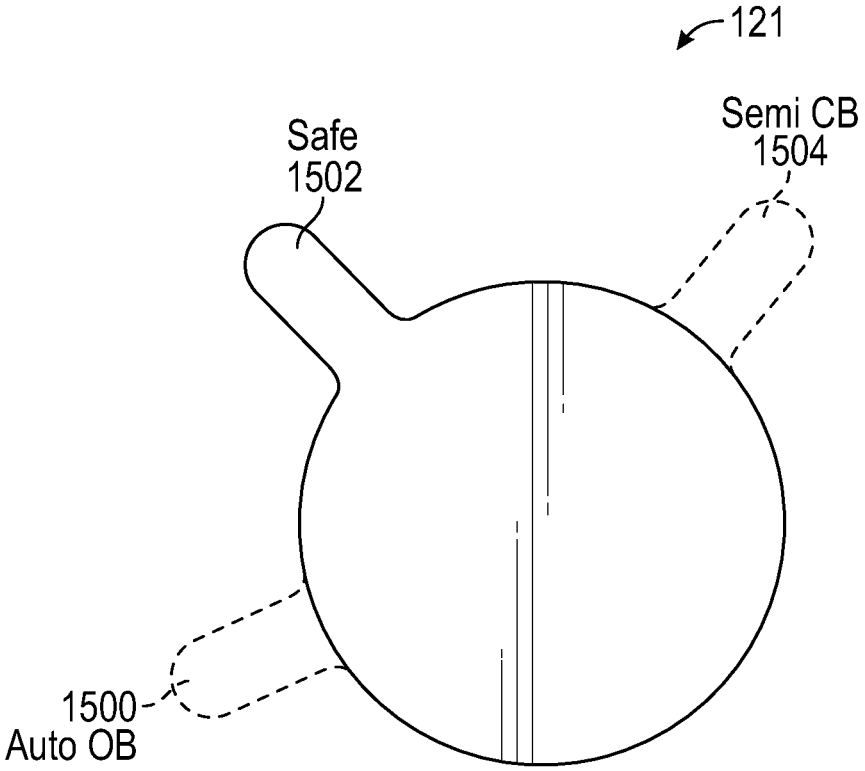
FIG. 15 is a face-on view of a selector showing various positions of the selector according to an embodiment.

FIG. 15 shows a selector 121 having a first position 1500 associated with a fully automatic open bolt (AUTO OB) mode, a second position 1502 associated with a safe (SAFE) mode, and a third position 1504 associated with a semi-automatic closed bolt (SEMI CB) mode of operation. The risk button assembly may be configured to prevent a turn of the selector from the first position 1500 through the second position 1502 to the third position 1504 unless the button is compressed and to allow a turn of the selector from the third position 1504 through the second position 1502 to the first position 1500 without compression of the button.

Figure 16:
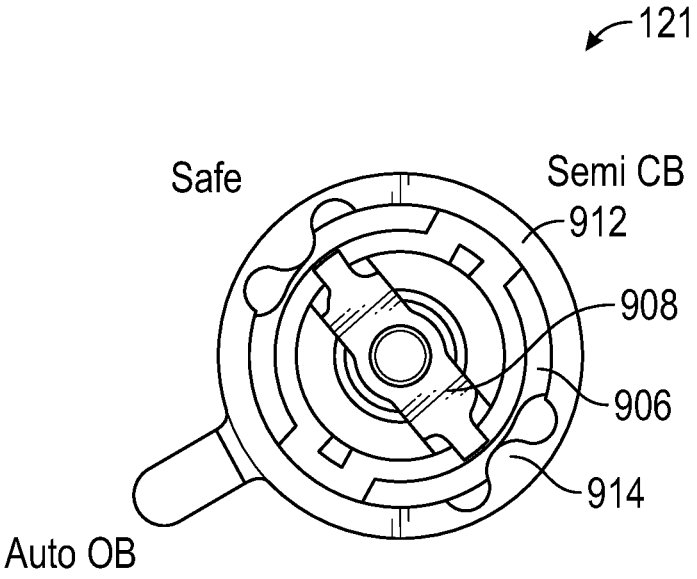
FIG. 16 is a face-on view of the risk button assembly of FIG. 10 in a fully automatic open bolt mode position according to an embodiment.
Figure 17:
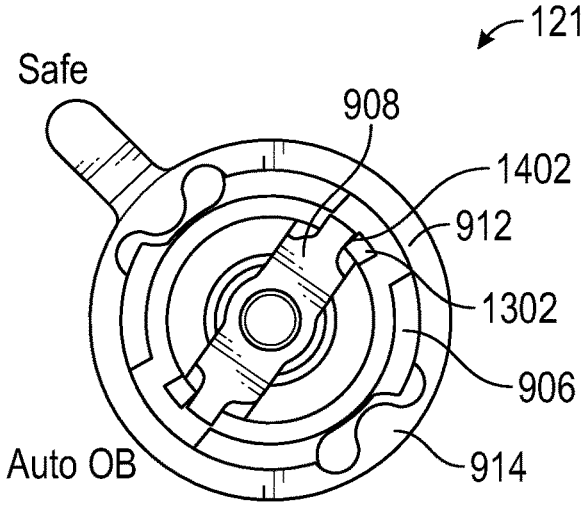
FIG. 17 is a face-on view of the risk button assembly of FIG. 10 in a safe mode position according to an embodiment.

FIG. 16 is a face on view of a selector 121 implemented with a risk button with the selector in an AUTO OB position. In this implementation, if selector 121 is moved to the SAFE position as shown in FIG. 17, the risk button plunger 908 must be depressed to move selector 121 into the SEMI CB position as block 1402 of plunger 908 is engaged with block 1302 of limited motion disk 906.

Figure 18:
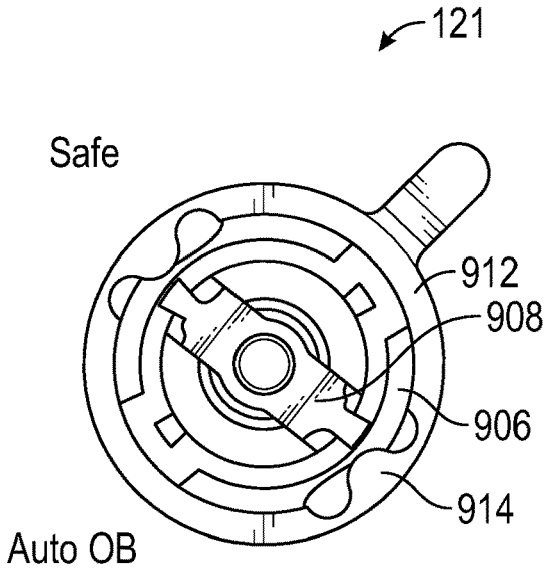
FIG. 18 is a face-on view of the risk button assembly of FIG. 10 in a semi-automatic open bolt mode position according to an embodiment.
Figure 19:
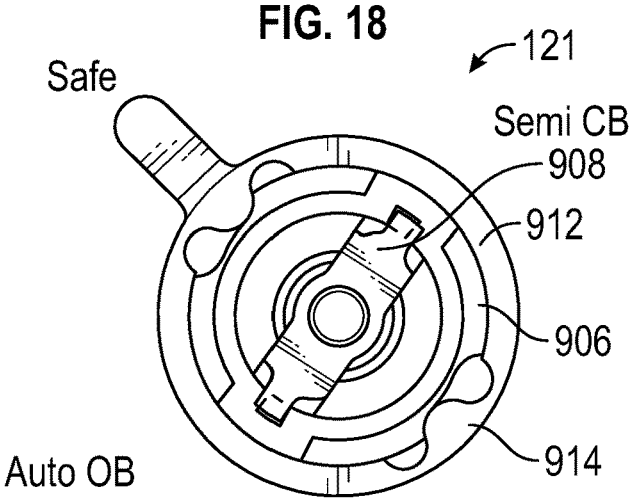
FIG. 19 is a face-on view of the risk button assembly of FIG. 10 in a safe mode position according to an embodiment.

FIG. 18 is a face on view of a selector 121 implemented with a risk button with the selector in a SEMI CB position. In this implementation, if selector 121 is moved to the SAFE position as shown in FIG. 19 (from the SEMI CB position of FIG. 18), risk button plunger 908 will start to ramp over the limited motion disk 906 as shown. If the selector 121 is moved further towards the AUTO OB position, it will pass the blocks 1302 on the limited motion disk 906 and risk button plunger 908 will have to be depressed to return to the SEMI CB position. As understood by one skilled in the art, the risk button assembly may be on the selector or located separately on the receiver of the firearm and interact with the selector. Furthermore, the risk button assembly and the selector may be rotated, slid, pushed, and/or switched, for example, as a rotary, slider, button, and/or switch/lever, respectively, to select a desired mode of operation.

It is common training for soldiers to ease the bolt forward after changing magazines and the bolt carrier is being held rearward by the last round stop, this practice prepares the weapon to be fired without making much noise. In order to ease the bolt forward the user must pull the charging handle back until it pulls the bolt carrier off the open-bolt sear and is held back by the charging handle. The trigger is then pulled to lower the open-bolt sear so that the carrier can proceed forward while the charging handle is slowly moved forward by the operator.

However, for a firearm that has been operated in full auto open bolt mode and thus has a heated barrel, if the user tries to ease the bolt forward to a closed bolt position the gun will fire unexpectedly when the round is chambered into the hot barrel. When the firearm has been operating in semi-auto mode, this easing procedure is still a safe and acceptable practice because in semi-auto mode, the round that is chambered won't accidentally fire when the bolt is eased forward. It's important however that the operator needn't remember this, particularly in combat situations. Firearm 100 may therefore be provided, in some embodiments, with a mechanism blocks pulling of the trigger following full auto operation and allows pulling of the trigger for easing the bolt forward in other scenarios.

Figure 20:
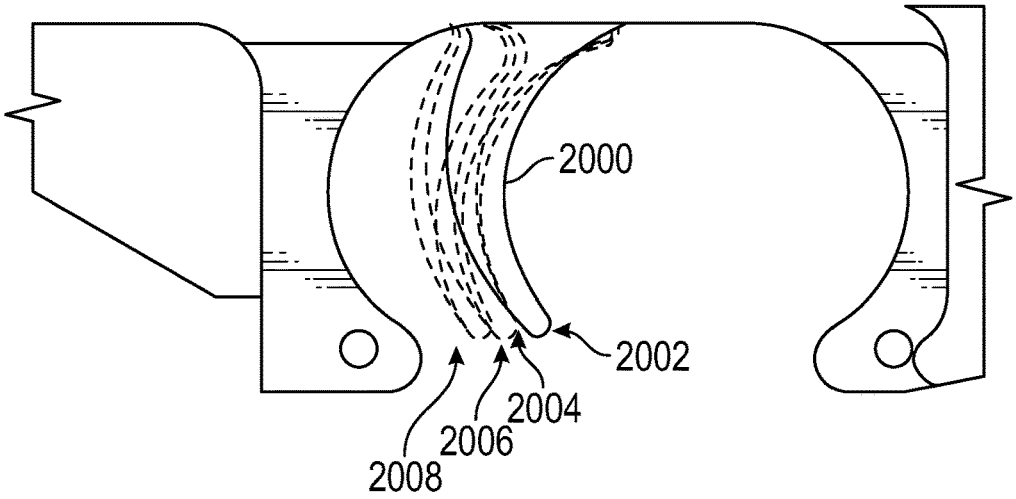
FIG. 20 is a side view of a firearm trigger showing various positions of the trigger according to an embodiment.

A trigger in a selective fire firearm may have various positions based on the operational mode and operation of the firearm. For example, as shown in FIG. 20, a trigger 200 (e.g., a trigger suitable for use in firearm 100 as described herein, may have forward positions 2002 and 2006 respectively for semi-auto and full auto modes of operation. Because the forward position 2006 for the full auto mode is further back than the forward position 2002 for the semi-auto mode, the pulled position 2008 for the full auto mode (e.g., the position that releases the open bolt sear in an AUTO OB mode) is further rearward than the pulled position 2004 for the semi-auto mode (e.g., the position that releases the hammer from the trigger sear).

Figure 21:
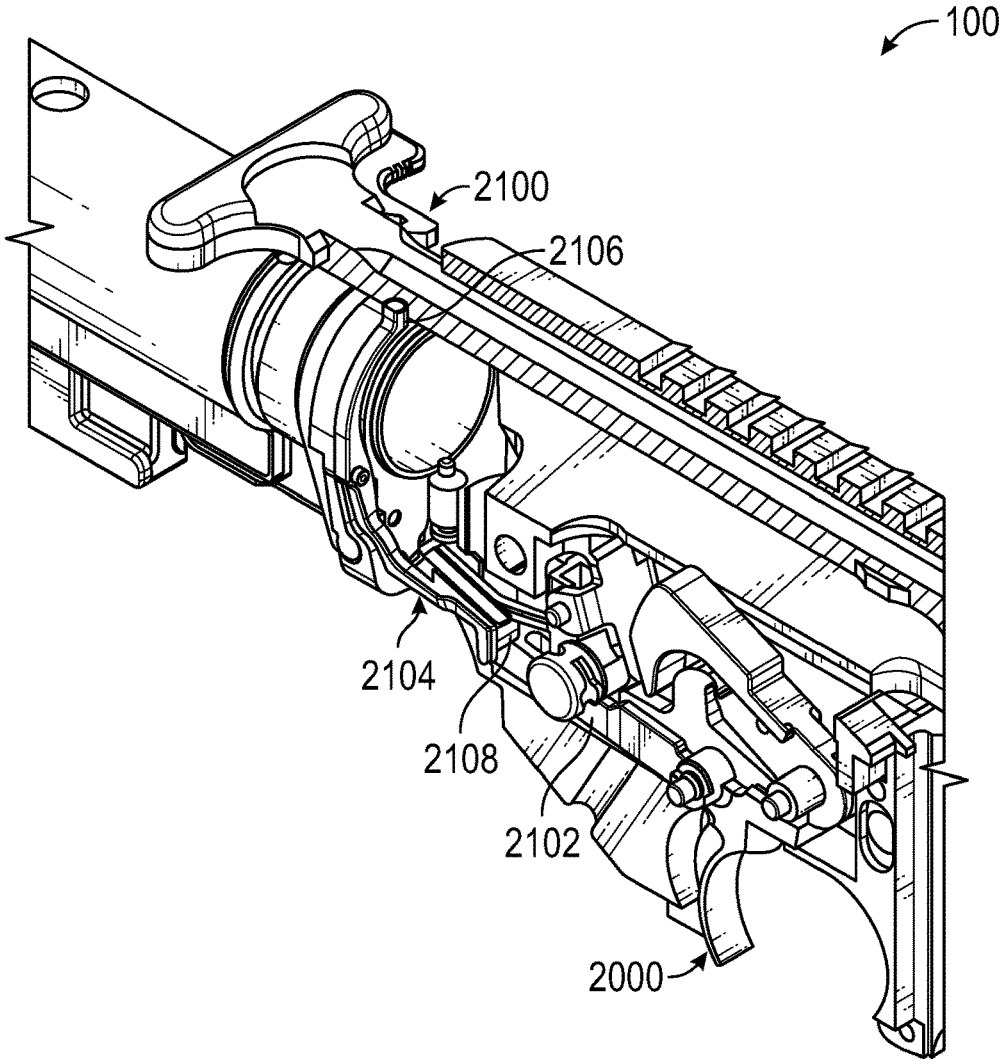
FIG. 21 is a perspective cutaway view of a portion of a firearm having a lever arm according to an embodiment.

FIG. 21 shows a perspective cutaway view of a firearm 100 having a mechanism for both allowing pulling of the trigger to position 2004 and preventing pulling of the trigger to position 2008 (which would release the open bolt sear) when the charging handle of the firearm is pulled, thereby preventing the operator from easing the bolt forward past the open bolt sear in full auto mode and reducing or eliminating the risk of accidental firing of the weapon. As shown in FIG. 21, a lever arm such as a trigger block lever arm 2104 may be provided.

Lever arm 2104 may have a first end portion 2106 and an opposing second end portion 2108. Second end portion 2108 may extend over rear portion 2102 of trigger 2000 when charging handle 2100 is pulled back as in the configuration of FIG. 21 due to interaction between first end portion 2106 and charging handle 2100. The interaction between first end portion 2106 and charging handle 2100 is illustrated in the top cutaway views of FIGS. 22 and 23.

Figure 22:
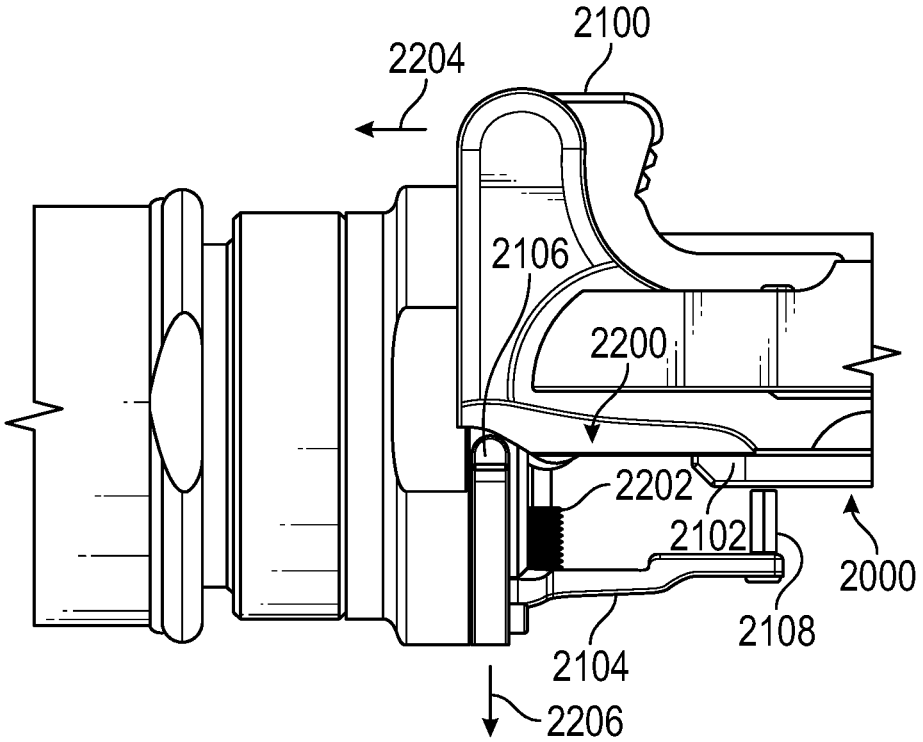
FIGS. 22 and 23 are top cutaway views of a portion of a firearm having a lever arm and a charging handle with the charging handle in respective forward and rearward positions according to an embodiment.

As shown in FIG. 22, when charging handle 2100 is in a forward position (e.g., not pulled back), first end portion 2106 of lever arm 2104 may be separated from contact with charging handle 2100 and a spring 2202 may bias second end portion 2108 away from rear portion 2102 of trigger 2000 preventing second end portion 2108 from affecting the operation of trigger 2000. When charging handle 2100 is pulled rearward (e.g., in direction 2204), a cam surface 2200 on charging handle 2100 may contact first end portion 2106 pushing first end portion 2106 outward (e.g., in direction 2206).

Figure 23:
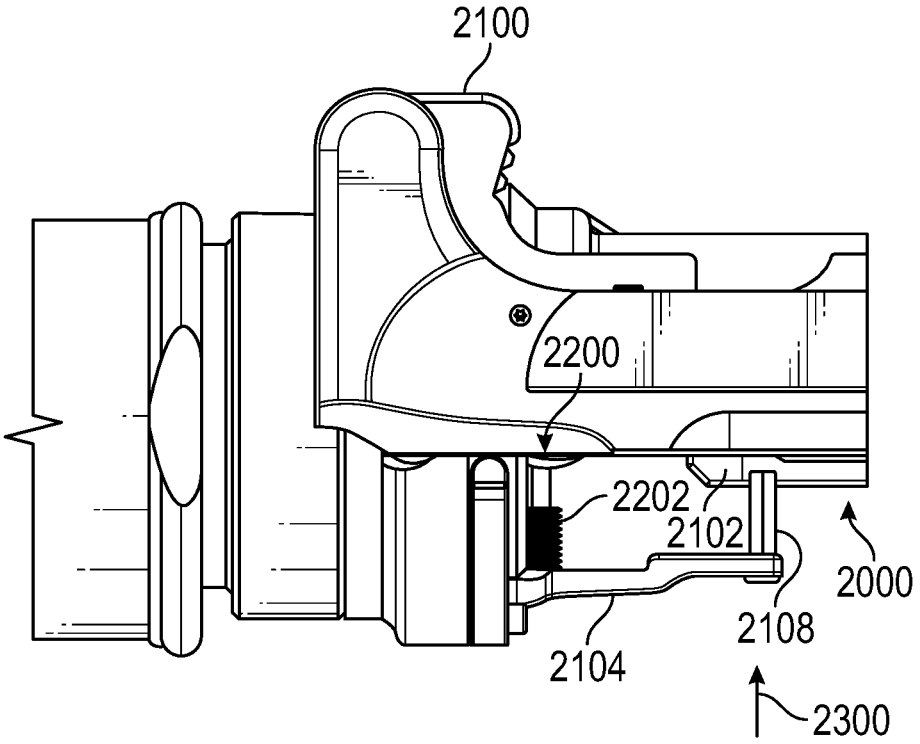

As shown in FIG. 23, when first end portion 2106 is pushed outward by cam surface 2200, spring 2202 may be compressed and second end portion 2108 may move in an opposite direction 2300 from a first position away from trigger 2000 (see FIG. 22) into a second position over rear portion 2102 (see FIG. 23) so that, in full auto mode, second end portion 2108 can prevent trigger 2000 from being pulled to position 2008 of FIG. 20 while allowing trigger 2000 to be pulled to position 2004.

In this way, a trigger block lever arm may be provided that tracts on a cam surface on the charging handle, so that when the charging handle is pulled back, the lever arm is pivoted so it blocks the trigger from being pulled so that the operator can't ease the bolt past the open-bolt sear and, since the full-auto trigger pull is beyond the semi-auto trigger pull, the lever arm only blocks the trigger from being pulled while the firearm is in full auto mode and not while it is in semi-auto mode.

Figure 24:
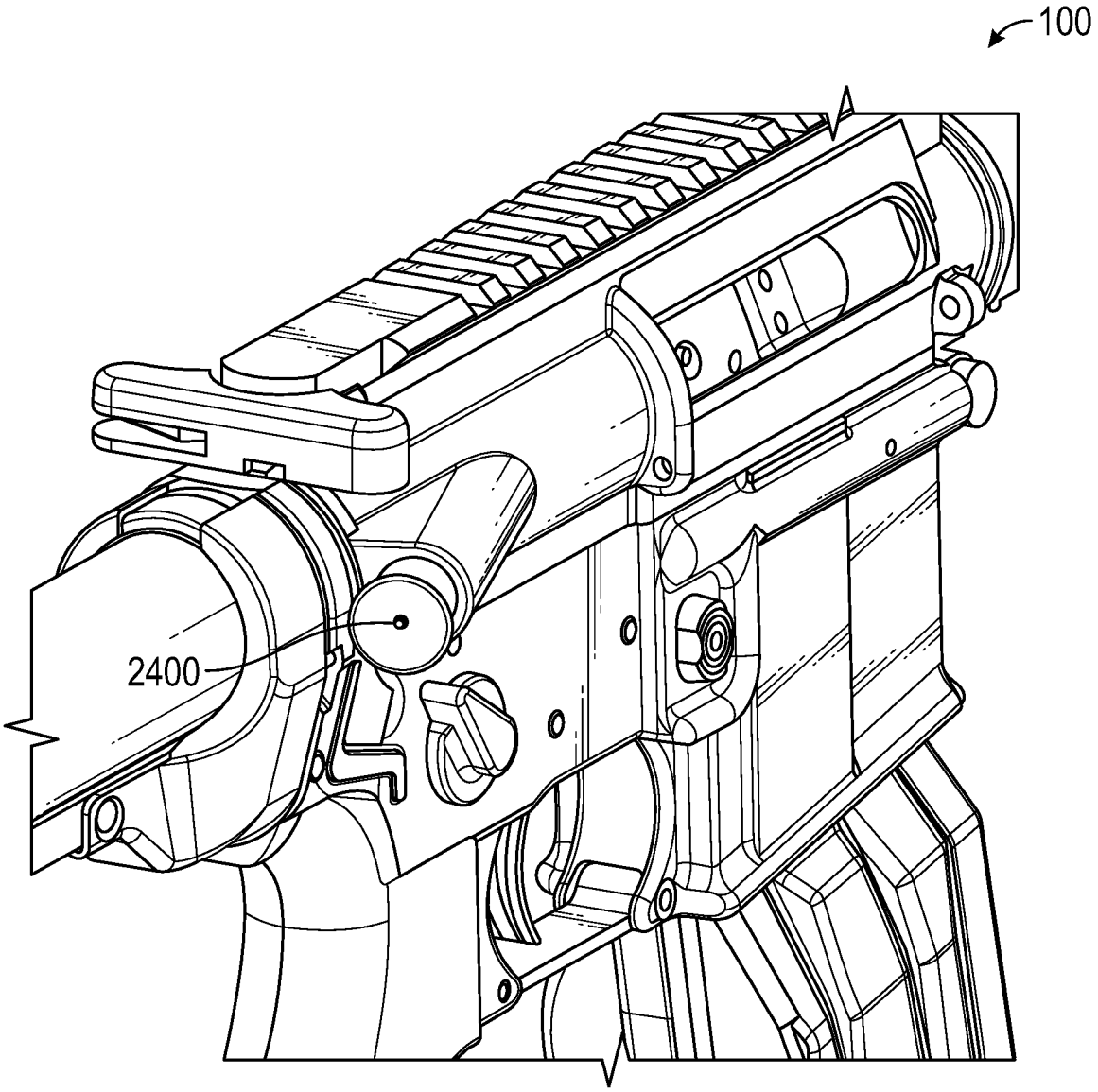
FIG. 24 is a perspective view of a forward assist button of a firearm according to an embodiment.

In one or more embodiments, the upper receiver of firearm 100 may have a forward assist button 2400 as shown in FIG. 24 which may be used to force the bolt carrier assembly forward if the assembly gets stopped out of battery. The button 2400 can be depressed by the operator, which forces a plunger forward that engages notches cut on the bolt carrier and forces the bolt carrier forward. However, when the firearm is in a full auto open bolt mode of operation, if the trigger is pulled and the bolt carrier assembly gets stopped before firing a round and the operator uses the forward assist to force the bolt carrier forward, once the bolt carrier assembly reaches its locked position the round may fire whether the trigger is still pulled or not. Once the round fires the bolt carrier will recoil rearward with high energy and force the depressed forward assist plunger rearward into the hand of the operator causing possibly injury.

Figure 25:
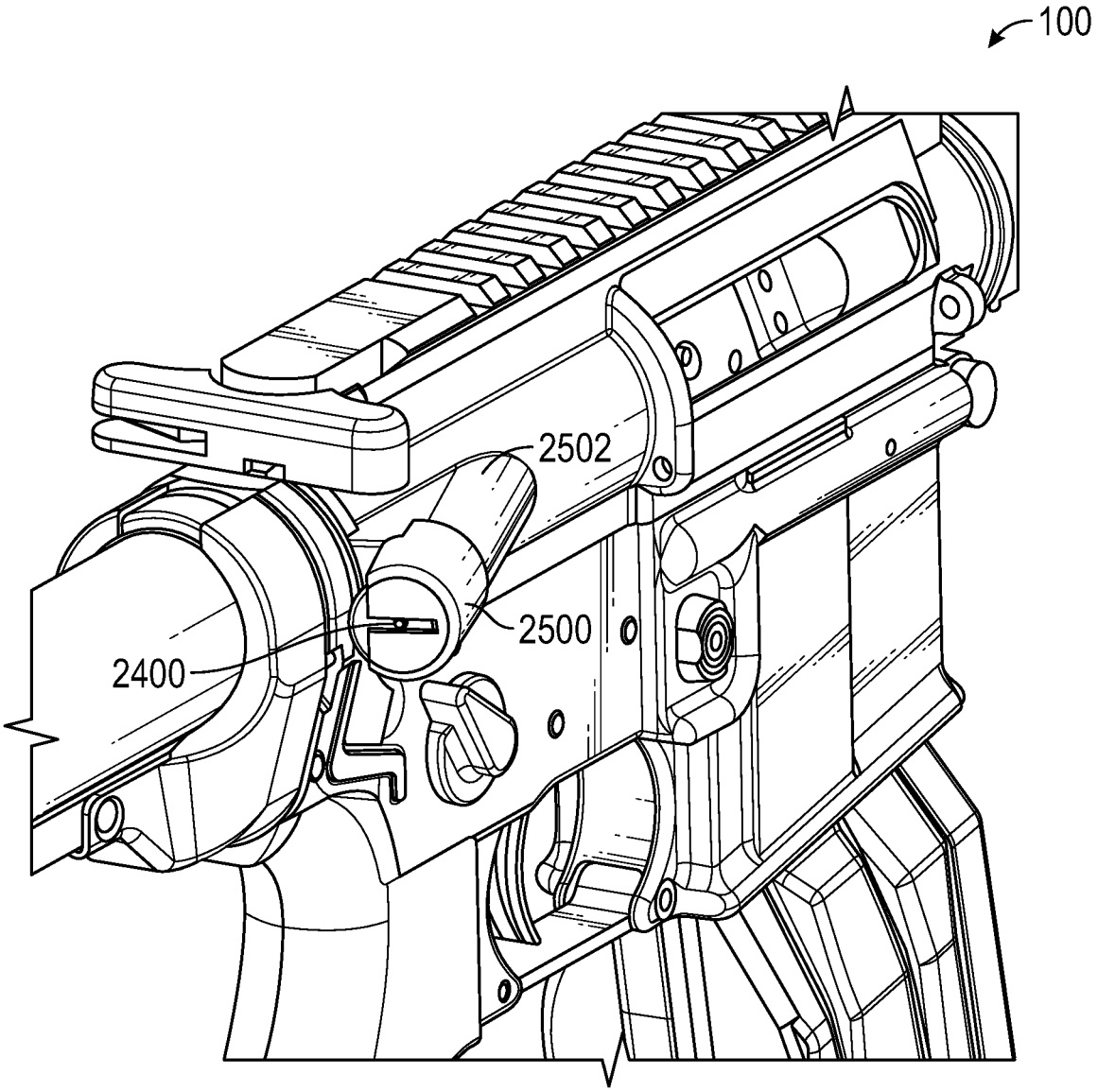
FIG. 25 is a perspective view of a forward assist cover on a forward assist button of a firearm according to an embodiment.
Figure 26:
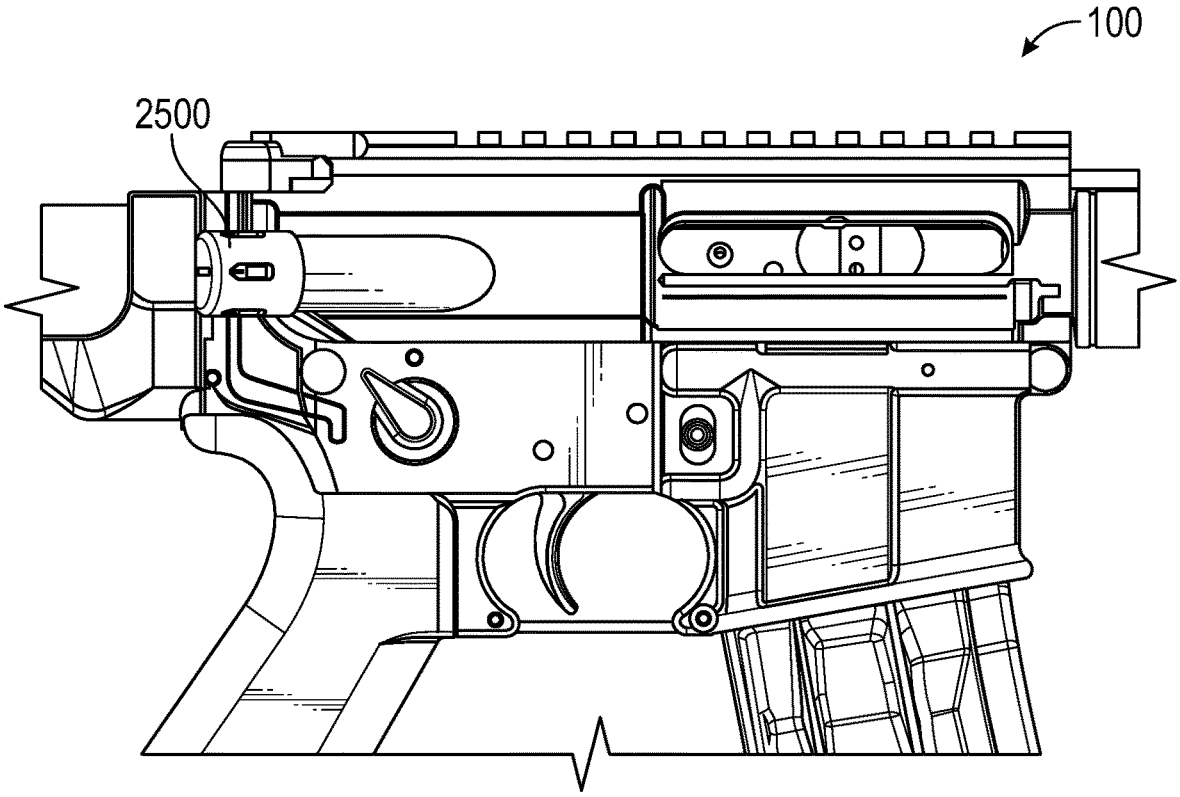
FIG. 26 is a side view of a forward assist cover on a forward assist button of a firearm according to an embodiment.

An optional-use cover such as cover 2500 of FIG. 25 may be provided for the forward assist button 2400 that, when installed on the button 2400, prevents an operator from pushing the forward assist button. Cover 2500 may be configured to be easily installed and removed from button 2400 without specialized tools and may have a surface that abuts an outer surface of a portion 2502 of the upper receiver to prevent button 2400 from being pushed. For example, the operator of firearm 100 may install the cover 2500 on button 2400 (e.g., by snapping the cover onto the button) when using the firearm in full auto open bolt mode. FIG. 26 shows a side view of firearm 100 with cover 2500 installed on the forward assist button 2400.

Figure 27:
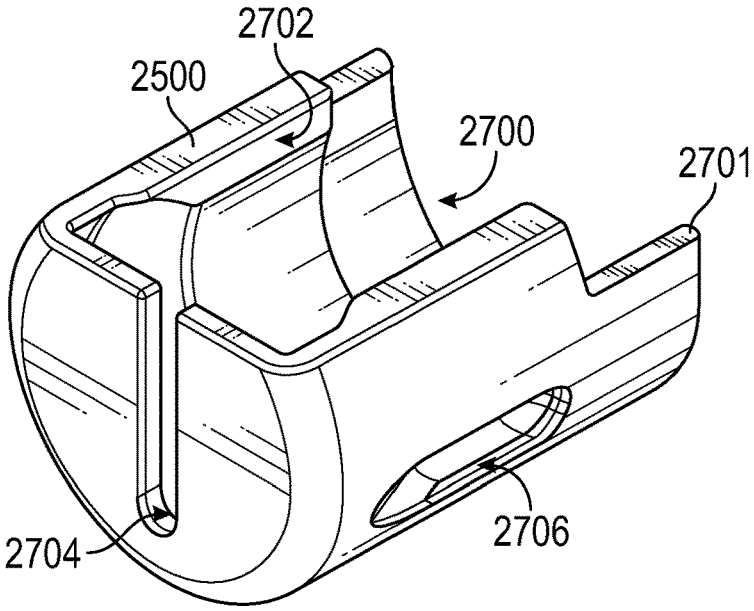
FIG. 27 is a perspective view of a forward assist cover for a firearm according to an embodiment.

FIG. 27 shows a perspective view of cover 2500. As shown in FIG. 27, cover 2500 may be formed from structure 2701 that defines a cavity 2700 configured to receive forward assist button 2400. Structure 2701 may be formed from plastic, rubber, metal, ceramics, or other suitable materials. In one suitable example, structure 2701 may be a molded plastic structure. Structure 2701 may include an opening 2702 on one side and may be formed from a resilient material that allows button 2400 to be pushed into cover 2500 via opening 2702 and to snap onto button 2400 once button 2400 is within cavity 2700. Structure 2701 may be provided with additional features such as slot 2704 and/or opening 2706. Slot 2704 may facilitate stretching of cover 2500 onto button 2400 (e.g., by reducing the force needed to stretch opening 2702 during installation of cover 2500 and reducing the risk of breaking cover 2500 during installation and/or removal).

In accordance with one or more embodiments of the present disclosure, an open bolt sear assembly for a firearm, such as firearm 100, may be provided that can be used to increase the reliability of the firearm by preventing possible misfires. For example, FIGS. 28A and 28B show exemplary configurations of an open bolt sear assembly engaged and disengaged, respectively, with a bolt carrier in accordance with an embodiment.

The open bolt sear of the open bolt sear assembly may permit the maintaining of desired performance aspects, while keeping a lower receiver compatible with a contemporary assault rifle (e.g., standard issue military AR). For example, a pivot location for the open bolt sear arm provides balance between adequate sear engagement and trigger pull travel, as discussed further herein.

Figure 28A:
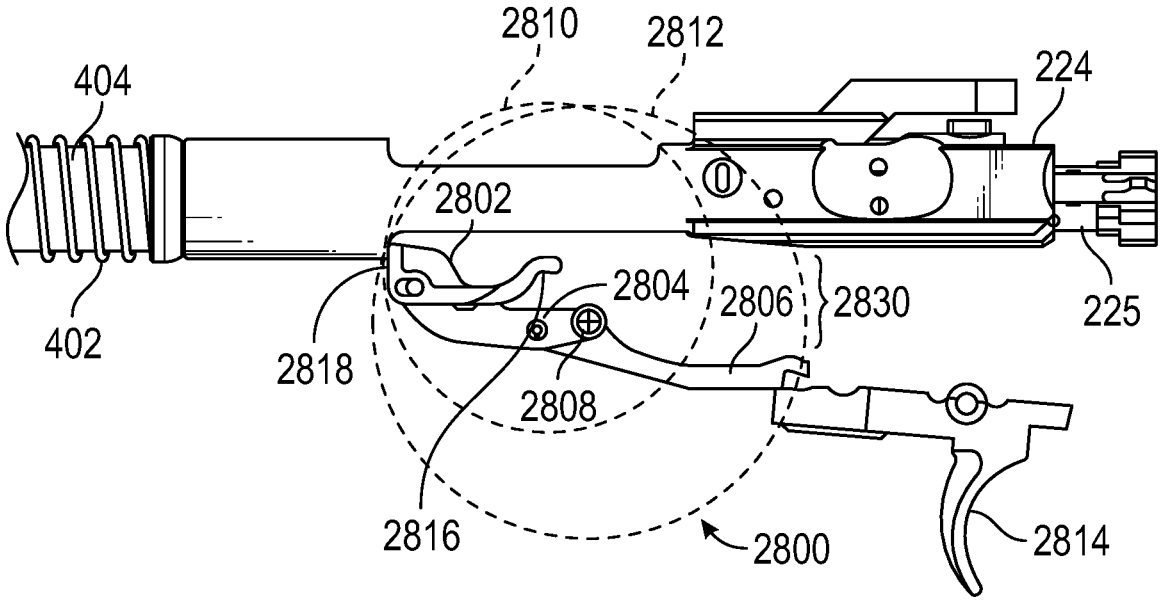
FIGS. 28A and 28B are side views of an open bolt sear engaged and disengaged, respectively, with a bolt carrier group of a firearm according to an embodiment.
Figure 28B:
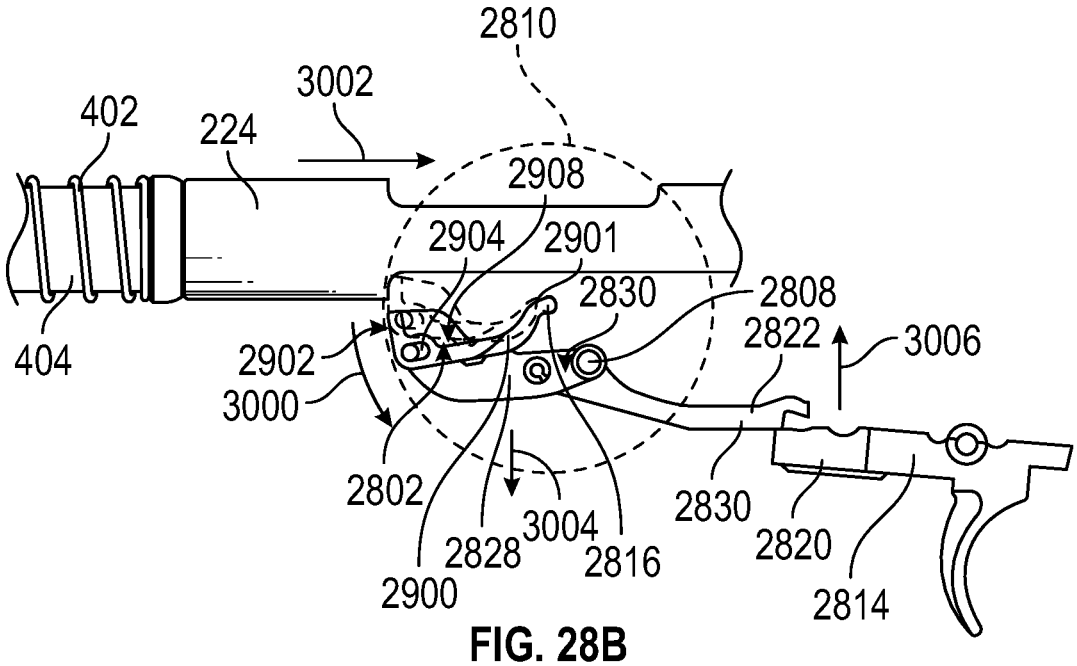
Figure 29B:
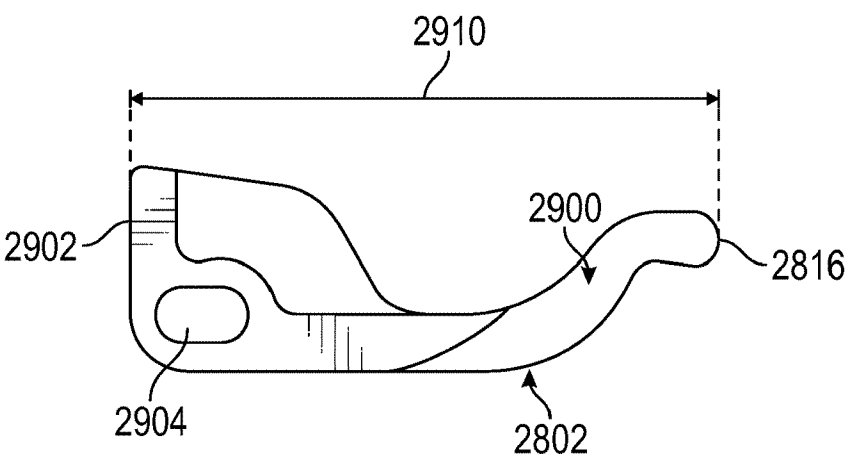
FIGS. 29A-29D are various views of the open bolt sear according to an embodiment.
Figure 29D:
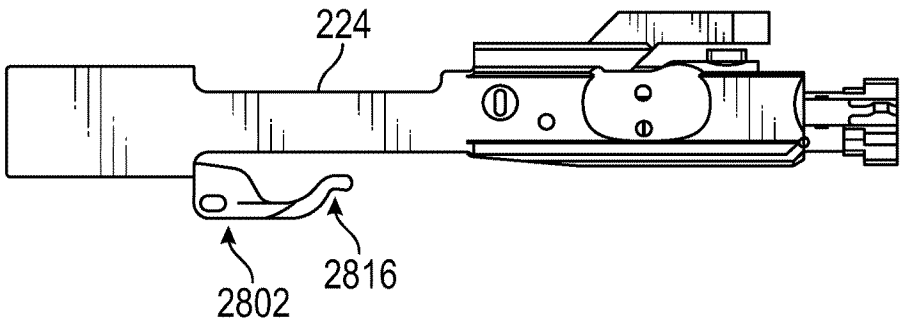
Figure 29A:
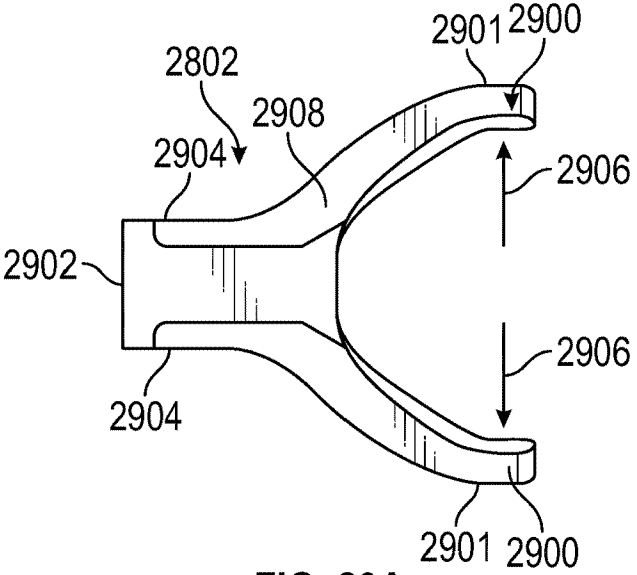
Figure 29C:
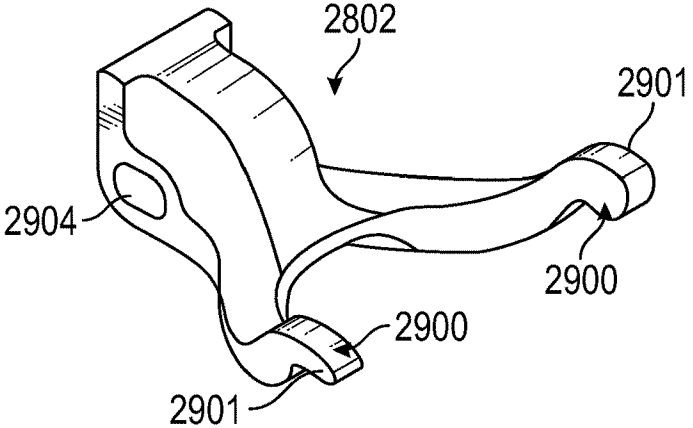

FIG. 28A shows an open bolt sear assembly 2800 engaged with bolt carrier 224 according to an embodiment. Open bolt sear assembly 2800 (also referred to as a "dual pivot open bolt sear" or "dual sear pivot" herein) may be used when the selector (e.g., selector 121) is on AUTO OB mode. As shown in FIG. 28B, open bolt sear assembly 2800 includes an open bolt sear 2802, a sear arm 2830 with a first end 2822 and a second end 2828, and other individual components as discussed herein. Open bolt sear assembly 2800 illustrates a dual pivot open bolt sear, such that, for example, open bolt sear assembly has two pivot locations: sear arm pivot 2808; and open bolt sear pivot 2816. For ease of fabrication, sear arm 2830 may be manufactured as two separate sear arms, such as sear arms 2804 and 2806, that may be coupled together (e.g., at sear arm pivot 2808). In one or more embodiments, once coupled, sear arms 2804 and 2806 may operate as a single sear arm and are pivoted about sear arm pivot 2808 in unison. In another embodiment, sear arm 2830 may be manufactured as a single, monolithic sear arm.

In one or more embodiments of the present disclosure, the open bolt sear assembly 2800 may be used in a contemporary firearm, such as an M16 or M4 assault rifle, and/or other firearms such as, for example, firearm 100. In an embodiment of the present disclosure, open bolt sear assembly 2800 allows open bolt sear 2802 to maintain adequate sear engagement with bolt carrier 224 under various circumstances. More specifically, a firearm using open bolt sear assembly 2800 may pass a drop test or a substantial impact to the firearm that may otherwise cause the firearm to discharge unexpectedly (e.g., slamfire).

The possibility of a misfire resulting from dropping or jarring a firearm may not be solved by a feature such as a stronger main spring without resulting in a substantial increase in trigger pull resistance. The dual sear pivot 2800, however, may prevent misfires without substantially increasing the trigger pull resistance.

Open bolt sear assembly 2800 may hold the bolt carrier group (BCG) (e.g., bolt carrier 224 and bolt 225) in place when engaged with open bolt sear 2802 without resulting in a substantially high trigger pull resistance (i.e. trigger pull weight). The pivot location for the open bolt sear arm provides balance between substantial sear engagement and trigger pull travel. For example, a travel path 2812 of the open bolt sear 2802 from the open bolt sear arm pivot 2808 location illustrates how open bolt sear 2802 must force bolt carrier 224 rearward (e.g., toward the firearm stock) and compress main drive spring 402 before it releases bolt carrier 224. The additional resistance necessary to force bolt carrier 224 rearward significantly raises the trigger pull weight. However, the open bolt sear assembly 2800 provides a second pivot point, open bolt sear pivot 2816, relatively in-line with a contact point 2818 between bolt carrier 224 and open bolt sear 2802. Pivot point 2816 thus creates a more vertical travel path (denoted by path 2810) of bolt sear 2802 and reduces the rearward travel of bolt carrier 224, compression of main drive spring 402, and thus the weight of the trigger pull. Furthermore, the relatively in-line pivot location at 2816 reduces the moment arm, which reduces the force and stress on open bolt sear 2802, increasing reliability of the firearm.

FIG. 28B shows open bolt sear assembly 2800 disengaged from bolt carrier 224 of a firearm in accordance with one or more embodiments of the present disclosure. Open bolt sear assembly may be disengaged from bolt carrier 224 by, for example, a user pulling a trigger 2814 (e.g., rear portion 2820 of trigger 2814 may engage or lift first end 2822 of sear arm 2830). As understood by one skilled in the art, various triggers, such as triggers 202 and 702, may also be used with open bolt sear assembly 2800. In the disengaged configuration, open bolt sear 2802 is disengaged from bolt carrier 224 by sear arm 2830 pulling downward on open bolt sear 2802, resulting in open bolt sear 2802 pivoting at open bolt sear pivot 2816. Open bolt sear pivot 2816 is provided by engagement surfaces 2901 (see FIGS. 29A-D) of legs 2900 contacting opposing inner surfaces of a lower receiver, such as lower receiver 102 of firearm 100. Thus, engagement surfaces 2901 abut the interior surfaces of the lower receiver and open bolt sear 2802 is securely wedged between opposing inner surfaces of the firearm. Slot 2904 may receive a portion of sear arm 2830 to couple open bolt sear 2802 and sear arm 2830.

For example, when trigger 2814 is pulled by a user, sear arm 2830 rotates at pivot 2808 (as indicated by directional arrows 3004 and 3006) and pulls body 2908 of open bolt sear 2802 in the direction indicated by arrow 3000 (e.g., relatively downward or away from the bolt carrier group), disengaging bolt carrier 224 and open bolt sear 2802. As a result, bolt carrier 224 is forced in the direction indicated by arrow 3002 (e.g., forward or toward the barrel) by main spring 402. The bolt carrier group cycles and the firearm operates as described previously herein during the duration trigger 2814 is held by the user in AUTO OB mode. Once trigger 2814 is released, sear arm 2830 is rotated (e.g., ends 2828 and 2822 move in directions relatively opposite of arrows 3004 and 3006, respectively) by, for example, a spring. As a result of the rotation of sear arm 2830, open bolt sear 2802 is pushed relatively upward in an opposite direction of arrow 3000 and at least partially into the travel path of bolt carrier 224. Bolt carrier 224 is then stopped by open bolt sear assembly 2800 as mentioned herein and full automatic firing is ceased until trigger 2814 is pulled again.

FIGS. 29A-D show various views of open bolt sear 2802 in accordance with one or more embodiments of the disclosure. Open bolt sear 2802 has an elastic wishbone design (e.g., a substantially Y-shaped frame 2910 formed by body 2908 and legs 2900). More specifically, open bolt sear 2802 acts like a spring and dampens the impact force from bolt carrier 224 to prevent misfires.

A contemporary, fully automatic AR rate of fire may, for example, range 750 to 1200 rounds per minute cyclic; the bolt carrier travels back and forth with each cycle. In one or more embodiments of the present disclosure, when the trigger is released mid-fire, open bolt sear assembly 2800 is spring loaded to move into the bolt carrier's travel path and block the bolt carrier from cycling forward. The bolt carrier may impact open bolt sear 2802 with a substantial amount of momentum and force. The bolt carrier impacts open bolt sear 2802 on an impact surface (e.g., mating face 2902). The wishbone design allows legs 2900 to flex outwards during impact, as indicated by arrows 2906 of FIG. 29A, thus dispersing the impact force over more time which reduces the peak force and stress. The forces are thus directed into the receiver (e.g., lower receiver 102 of firearm 100), rather than passing the load through a retaining/pivot pin or other parts used in conventional open bolt sear assemblies. If the forces and stress exerted on the open bolt sear by the bolt carrier are not dampened, the contact of the open bolt sear and the bolt carrier may cause the open bolt sear to oscillate, which may result in the bolt carrier passing and riding over the open bolt sear and possibly firing one or more rounds.

The various embodiments discussed herein may provide various advantages for safe and efficient use of a firearm, particularly a selective fire firearm having a fully automatic open bolt mode of operation and a semi-automatic closed bolt mode of operation.

While the invention has been described in detail in connection with only a limited number of embodiments, it should be readily understood that the invention is not limited to such disclosed embodiments. Rather, the invention may be modified to incorporate any number of variations, alterations, substitutions or equivalent arrangements not heretofore described, but which are commensurate with the spirit and scope of the invention. Additionally, while various embodiments of the invention have been described, it is to be understood that aspects of the invention may include only some of the described embodiments. Accordingly, the invention is not to be seen as limited by the foregoing description, but is only limited by the scope of the appended claims.

Features may be removed, disabled, or not used in any desired type of firearm described herein. Thus, the features describe in conjunction with each type of firearm may be mixed and matched as desired and are by way of example only, and not by way of limitation.

Embodiments described above illustrate, but do not limit, the invention. It should also be understood that numerous modifications and variations are possible in accordance with the principles of the present invention. Accordingly, the scope of the invention is defined only by the following claims.

What is claimed is:

1. A trigger group, comprising:

a dual use trigger, comprising:

a trigger sear configured to engage a hammer notch of a standard hammer; and a light pull sear configured to engage a hammer post of a light pull hammer; and a single disconnect configured to operate with both the standard hammer and the light pull hammer.

2. The trigger group of claim 1, further comprising:

the standard hammer, wherein the standard hammer is free of features that engage the light pull sear; and wherein the standard hammer comprises a portion configured to engage the single disconnect and an extended portion having the hammer notch configured to engage an auto sear.

3. The trigger group of claim 1, further comprising:

the light pull hammer comprising the hammer post; and wherein the hammer post is configured to engage the light pull sear on a first side and the single disconnect on an opposing second side.

4. A firearm comprising the trigger group of claim 1 and configured to receive the standard hammer or the light pull hammer.

5. The trigger group of claim 1, wherein the trigger has a forward position for a fully automatic open bolt mode of operation that is different from a forward position for a semi-automatic closed bolt mode of operation.

6. The trigger group of claim 1, wherein the trigger has a pulled position for a fully automatic open bolt mode of operation that is different from a pulled position for a semi-automatic closed bolt mode of operation.

7. The trigger group of claim 1, wherein a rear portion of the trigger is configured to be propped by a trigger prop.

8. The trigger group of claim 1, further comprising the light pull hammer, wherein the light pull hammer is associated with a lighter pull weight than a pull weight for the standard hammer.

9. The trigger group of claim 2, wherein the hammer notch is configured to engage the trigger sear at a location relatively closer to a hammer pivot of the hammer notch than the light pull sear.

10. The trigger group of claim 2, further comprising a trigger prop configured to be moved rearward from under a rear portion of the trigger so that the trigger sear engages the hammer notch, wherein the auto sear is configured to be retracted so that the standard hammer rests on the trigger sear.

11. The trigger group of claim 3, wherein the light pull hammer comprises a cutaway portion configured to provide clearance with the trigger sear to prevent the trigger sear from engaging the light pull hammer.

12. The trigger group of claim 3, wherein the hammer post is configured to extend beneath the light pull sear to control release of the light pull hammer.

13. The firearm of claim 4, wherein:

the dual use trigger has a forward position for a fully automatic open bolt mode of operation that is different from a forward position for a semi-automatic closed bolt mode of operation; and/or the dual use trigger has a pulled position for a fully automatic open bolt mode of operation that is different from a pulled position for a semi-automatic closed bolt mode of operation.

14. The firearm of claim 4, further comprising:

a charging handle; and a lever arm, wherein, based on a position of the charging handle and a mode of operation of the firearm, the lever arm is configured to selectively block or allow a pull of the dual use trigger.

15. A firearm, comprising:

a dual use trigger comprising:

a trigger sear configured to engage a hammer notch of a standard hammer; and a light pull sear configured to engage a hammer post of a light pull hammer, wherein the firearm is configured to receive the standard hammer or the light pull hammer; and a trigger prop configured to prop a rear portion of the dual use trigger in a fully automatic open bolt mode of operation.

16. The firearm of claim 15, further comprising:

a bolt carrier; and an open bolt sear configured to block motion of the bolt carrier to prevent firing when the dual use trigger is released in the fully automatic open bolt mode of operation of the firearm.

17. A firearm, comprising:

a dual use trigger comprising:

a trigger sear configured to engage a hammer notch of a standard hammer; and a light pull sear configured to engage a hammer post of a light pull hammer, wherein the firearm is configured to receive the standard hammer or the light pull hammer; and a selector operable to select a semi-automatic closed bolt mode of operation or a safe mode for the firearm.

18. The firearm of claim 17, wherein the selector is operable to select a fully automatic open bolt mode of operation, the semi-automatic closed bolt mode of operation, or the safe mode for the firearm.

19. A method of making the firearm of claim 4, the method comprising:

receiving a selected one of the standard hammer or the light pull hammer;

assembling the trigger group comprising the trigger and the selected one of the standard hammer or the light pull hammer; and inserting the trigger group into a lower receiver of the firearm.

20. The method of claim 19, further comprising:

removing the trigger group from the lower receiver;

reassembling the trigger group by replacing either the light pull hammer or the standard hammer with the other; and inserting the reassembled trigger group into the lower receiver.

21. The method of claim 19, wherein, if the light pull hammer is received, the light pull hammer is received such that the hammer post of the light pull hammer is located farther away from a hammer pivot of the light pull hammer than a location of a notch of the standard hammer if the standard hammer is received.

22. The method of claim 21, further comprising, when in a semi-automatic closed bolt mode of operation and a selector is moved from semi-auto to full auto:

firing a first fully automatic burst from a closed bolt configuration;

stopping the first fully automatic burst in an open bolt configuration; and firing a subsequent fully automatic burst from the open bolt configuration.

* * * * *